US005237904A

United States Patent [19]

Kuhlmann-Wilsdorf

[11] Patent Number: 5,237,904

[45] Date of Patent: Aug. 24, 1993

[54] ARMATURE/PROJECTILE FOR A SINGLE OR MULTI-TURN RAIL GUN

[76] Inventor: Doris Kuhlmann-Wilsdorf, 1865 Fendall Ave., Charlottesville, Va. 22903

[21] Appl. No.: 140,825

[22] Filed: Jan. 5, 1988

[51] Int. Cl.[5] ..... F42B 6/00

[52] U.S. Cl. ..... 89/8; 102/517; 102/522; 102/523; 124/3

[58] Field of Search ..... 89/8; 102/517-523; 124/3

[56] References Cited

U.S. PATENT DOCUMENTS

| | | | |
|---|---|---|---|
| H237 | 3/1987 | Levy | 89/8 |
| H357 | 11/1987 | Howland et al. | 89/8 |
| 4,329,971 | 5/1982 | Kemeny et al. | 89/8 |
| 4,369,692 | 1/1983 | Kemeny | 89/8 |
| 4,430,921 | 2/1984 | Hughes et al. | 89/8 |
| 4,577,545 | 3/1986 | Kemeny | 89/8 |
| 4,638,739 | 1/1987 | Sayles | 102/520 |
| 4,901,621 | 2/1990 | Tidman | 89/8 |
| 5,133,242 | 7/1992 | Witt | 89/8 |

OTHER PUBLICATIONS

Moldenhauer et al., "Experimental Demonstration of an N-Turn EML", Proc. 2nd Symp. on Electromagnetic Launch Technology, Boston, Oct. 10-13, 1983 (IEEE New York 1983), pp. 85-88.

LA-8000-C, "Proceedings of the Impact Fusion Workshop", National Security and Resources Study Center, Los Alamos Scientific Laboratory, Los Alamos, N.M., Jul. 10-12, 1979, pp. 128-130, 140-141.

*Primary Examiner*—Stephen C. Bentley

*Attorney, Agent, or Firm*—Iandiorio & Dingman

[57] ABSTRACT

A non-transitioning armature/projectile for launching from a single or multi-turn rail gun including: a nose; a tail; and a current carrying section between the nose and the tail including current channeling means for reducing the current concentration in the tail end of the armature/projectile and distributing the current toward the nose for generally balancing the electrically induced driving force with the inertial force and substantially reducing internal stress in the section.

3 Claims, 12 Drawing Sheets

ARMATURE/PROJECTILE FOR A SINGLE OR MULTI-TURN RAIL GUN

FIELD OF INVENTION

This invention relates to an armature/projectile for launching by the magnetic driving force of a single or multi-turn rail gun and more particularly to a non-transitioning armature/projectile configured to reduce the current concentration in its tail and distribute the current toward the nose to reduce or eliminate local overheating and internal stress by balancing the electrically induced driving force and the inertial force in the armature/projectile.

BACKGROUND OF INVENTION

Rail guns are devices that launch a projectile by the magnetic (Lorenz) driving force of current carried between spaced, parallel conductive rails. The conductor used to pass the current across the space between the rails is called the armature. Four types of armatures are used. A solid armature is a body, at least partially composed of metal, conformed to the rails to make sliding metal/metal contact with the rails during launch. A plasma armature consists of ionized gases. It is typically triggered by vaporizing, via the launching current pulse, a metal foil spanning the gap between the rails. After having been started, the heat of the plasma discharge generates additional ions from surrounding surfaces. A transitioning armature is designed to function as a solid armature until it melts through bulk joule heating, after which a plasma armature takes over automatically. A hybrid armature will typically start as a solid armature but is designed to complete the launch by the establishment of a layer of plasma discharge between it and the rails on either side in lieu of solid/solid metal sliding.

The relative advantages and disadvantages of these types of armatures are these. Among the four types, solid armatures cause the smallest evolution of Joule heat at the armature/rail interfaces but waste the most friction heat. Below the speed at which gouging will be expected, which is between about 1 km/sec and 2 km/sec depending on choice of materials, they may cause little rail damage. Rail damage is of paramount importance because rail guns should be capable of firing up to thousands of times. It is probable that a speed limit exists beyond which these solid armatures cannot be accelerated, probably again between 1 km/sec and 2 km/sec. If not integrated with the projectile so that the current conducting metal at the same time performs a structural function, the solid armature represents useless mass that must be accelerated, named "parasitic mass".

Plasma armatures waste a maximum of Joule heat among the four types of armatures but are associated with a minimum of friction heat and of parasitic mass. They also have a great potential for damaging the rails.

Transitioning armatures are constructed to disintegrate, through melting on account of bulk joule heating, in some predetermined velocity range. Transitioning armatures are a different class from hybrid as well as solid armatures because the solid armature part thereof is designed to survive only to a speed well below the intended final speed of the payload. They have the advantages and disadvantages of the solid and plasma armature, before and after transitioning, respectively.

Hybrid armatures are designed for a short period of solid metal/metal sliding, and then establish a plasma between the solid armature body and rails. Much of the solid part of the armature survives the launch, however. Compared to solid armatures they waste Joule heat, with typical voltage drops across the two plasmas in the range of 100 volts as compared to only several volts across sliding metal/metal contacts, but suffer less frictional losses. Rail damage is typically slight, and achieved speeds are higher than with solid or transitioning armatures.

In rail gun operation, an armature is accelerated from the breech toward the muzzle end of the barrel. It travels in the bore defined by the rail surfaces and by insulators which are disposed between the rails to prevent current flow from one rail to another without passing through the armature. The armature may push a projectile or other payload ahead of it. Alternatively, the armature itself may serve as a projectile, or it may be integrated with one or more projectiles and/or other payloads. These configurations are called armature/-projectiles.

For an armature/projectile pushed from its breech end, the pressure due to the inertial force in the armature/projectile must not exceed its material fracture strength. As a result, the length of armature/projectiles is limited by the desired acceleration. As maximum attainable acceleration and desired velocity dictate barrel length, these factors determine the minimum barrel length required to launch the projectile. To the extent that maximum acceleration is limited by projectile material strength, rail guns with long, unwieldy barrels are needed to accelerate armature/projectiles to the desired high velocities.

Another problem with armature/projectiles is related to the magnitude and distribution of current. The accelerating force on the armature/projectile is directly related to the square of the current. Thus, high currents are required to accelerate the armature/projectile to useful velocities over acceptable barrel lengths. As a result, the rail guns must be externally supplied with extremely high currents.

As rail guns are being developed for applications requiring ease of transportation and aiming, and/or rapid firing, the demonstrated needed long barrel lengths and high currents pose a problem. Proposed uses for rail guns include terrestrial anti-tank guns and launchers and space-based anti-missile guns and launchers. Since Joule heating is proportional to the square of the current, the current-carrying components outside of the gun need to be correspondingly massive. Similarly, electric storage devices and switches also need to be massive.

In order to reduce the current, two modifications from the basic design above can be employed; augmented rail guns and stacked rail-guns. Both use multiple, parallel rails in two rail sets that replace the two single rails considered so far. In the augmented gun these are placed flat-on, side by side, with only one pair of rails along the bore. In the stacked gun, the rails are stacked on top of each other and each one forms part of the bore.

In the case of the side-by-side rails of the augmented gun, the current passes from the breech end up one inside rail, through the armature, and back down to the breech end of the other inside rail. The basic rail gun circuit thus completed, the current is then passed from the breech end of the second inside rail through a lead into the breech end of a rail parallel to and aligned with the first inside rail. From the muzzle end of that, the current is passed through another lead into the muzzle end of a corresponding rail on the opposite side and out its breech end. After forming this one extra current turn about the bore, one or more further such turns can be made by feeding the current through another lead in to the breech end of the next rail on the other side of the bore, the rails being successively displaced from the bore by one additional rail thickness. The magnetic field of the additional current turns increases or augments the magnetic field inside the bore, and thus increases the Lorenz force acting on the armature. The force is increased approximately in proportion with the number of rails used.

A multi-turn stacked rail gun has at least two pairs of rails exposed to the bore, as contrasted to the single exposed pair of the simple rail gun and the augmented gun. These rail pairs are stacked together into what basically is an n-turn solenoid. Each turn consists of the length from breech end to armature of one of a pair of rails, a part of the armature, from here on called a "stage", and the length from armature to breech end of the other rail of the pair, the turn being completed through a connecting lead to the first rail of the next pair at the breech end. The armature carries the current in each turn in separate, mutually electrically insulated stages which are stacked up in a direction normal to the direction of motion and are embedded in a single insulating block that together with the conducting parts completes the rail gun armature. This type of multi-turn gun was illustrated by J. G. Moldenhauer and G. E. Hauze, Proc. 2nd Symp. on Electromagnetic Launch Technology, Boston Oct. 10–18, 1983 (IEEE New York, 1983) p. 85–88.

For the same force and the same dimensions of the bore, the stacked rail gun theoretically needs only 1/nth the current of a single turn gun if there are n turns. However, neither the augmented nor the stacked multi-turn rail gun have improved the state of the art in relation to the maximum achievable projectile velocity at a given barrel length because of the limitation created by the material strength of the armature/projectile.

An additional problem arises due to the current skin effect, which causes the current flow lines carried through an armature to crowd in the tail or breech end of the armature. Because the current flows for only a very short time on the order of 0.0001 seconds, the current is able to penetrate only superficially into the armature. This shallow penetration depth has two consequences. First, local hot spots form and the material can overheat. In fact, the temperature increase in the breech end through high current density can melt most potential armature materials very quickly. This is a severe drawback in non-transitioning solid or hybrid armatures. Second, the unequal current distribution causes the force to be applied very non-uniformly, even in a simple armature which does not push a projectile. At least at the start of a launch the current crowds in the tail of the armature, and the Lorenz force is concentrated there. This condition leads to very high stress and material failure problems.

An improved armature, disclosed in U.S. Pat. No. 4,430,921, is theoretically designed to eliminate the hot spots and high current zones at the tail or breech end. The armature is made from multiple laminations with the conductivity of the laminae increasing from the tail to the nose or muzzle end. The conductivity is proposed to be graded to achieve uniform current distribution in rectangled armatures. This grading of electrical conductivities can be used with planar or chevron-shaped laminations.

Besides avoiding graded bulk Joule heating, such grading of electrical conductivity would ideally apply the electrically induced driving force more uniformly along the length of the armature. However, since the driving force is proportional to the square of the current density while the inertial force builds up linearly from the nose to the tail, if an armature/projectile of uniform material distribution is used, a uniform current distribution will only partially balance the inertial force, even if there is no separate projectile being pushed by the armature from its breech end. For more perfect relief of internal stress, the current flow lines must be moved from the tail and crowded towards the nose of the armature/projectile to generate a relative or absolute maximum of current density away from the tail. The prior art armatures can not accomplish this current distribution, largely for the reason that in fact most of the armature resistance resides at the rail/armature interfaces and not in the bulk of the armature.

Another problem with the design of U.S. Pat. No. 4,430,921 is that the armatures fail through detachment of the rear leaf. This has at least two causes. First, as already indicated, the bulk resistance of solid armatures is typically much smaller than the interfacial resistance between the armature and the rails, so that relative differences of bulk conductivity in the armature can not materially affect the current distribution in them unless resistivities in the bulk are made uneconomically high. Second, the crowding of the current into the rear leaf or leaves stimulates the penetration of magnetic flux into the gaps between the leaves, causing a corresponding pressure between them which leads to detachment of the rear leaf. A similar problem frequently occurs if an armature pushes a non-conducting projectile, in that an arc is prone to penetrate into the crack at the front end of the armature, leaving the armature behind and propelling the projectile only with a plasma.

To provide a rail gun in which the armature can be accelerated to optimal velocities, then, the current flow must be distributed by means other than grading of resistivities such that the electrically induced driving force balances the inertial force. This reduces internal stresses and hot spots, and allows acceleration to be limited only by the material strength of the rail gun itself, not the armature. The result is the ability to accelerate an armature to desired velocities with a rail gun that is small and light enough to be a practical launcher or weapon. In addition, the shorter travel times would also reduce ablation and rail damage, reduce friction losses, and improve energy conversion efficiency.

SUMMARY OF INVENTION

It is therefore an object of this invention to provide an armature/projectile that channels the current away from its tail.

It is a further an object of this invention to provide armature/projectile which can withstand increased accelerations.

It is a further object of this invention to provide an armature/projectile in which the driving forces and inertial forces are largely balanced.

It is a further object of this invention to provide an armature/projectile in which local overheating is reduced.

It is a further object of this invention to provide an armature/projectile which can achieve higher speeds.

It is a further object of this invention to provide an armature/projectile which can withstand longer launch times.

It is a further object of this invention to provide an armature/projectile of increased length to diameter aspect ratio.

It is a further object of this invention to provide an armature/projectile which distributes the current to eliminate the mechanical strength of the armature/-projectile as a limiting factor of its length.

It is a further object of this invention to provide an armature/projectile that can be fired from a relatively short and light rail gun.

It is a further object of this invention to provide an armature/projectile in which the current density increases from the tail to the nose to reduce internal stress.

It is a further object of this invention to provide a multiple-stage armature/projectile with stages aligned in the direction of motion and/or one on top of another.

It is a further object of this invention to provide a multiple-stage armature/projectile with the length of the stages adjusted to reduce internal stress.

It is a further object of this invention to provide an armature/projectile that can more easily carry a payload.

It is a further object of this invention to provide an armature/projectile that can more easily accelerate a projectile.

It is a further object of this invention to provide an armature/projectile that can launch longer projectiles.

It is a further object of this invention to provide an armature/projectile that can launch longer projectiles unencumbered by extraneous materials.

It is a further object of this invention to provide an armature/projectile that reduces the current requirements of a rail gun.

It is a further object of this invention to provide an armature/projectile that reduces the electric charge discharged per shot.

It is a further object of this invention to provide an armature/projectile that permits reducing or eliminating external self-inductances of rail gun systems.

It is a further object of this invention to provide an armature/projectile that is useful for terrestrial and space-based applications.

This invention results from the realization that internal stresses and local temperature peaks in an armature/projectile can be reduced or eliminated by reducing the current concentration in the tail end of the armature/projectile and channeling it toward the nose to balance the driving force and inertial force.

This invention features a non-transitioning armature/projectile for a rail gun. The armature/projectile has a nose, a tail, and a current carrying section between the nose and the tail including means for channeling the course of the current through the section for reducing the current concentration in the tail end of the section and distributing the current toward the nose for generally balancing the electrically induced driving force in the section with the inertial force and substantially reducing internal stress in the section. The section may include more than one means for channeling the course of the current through the section and may generally increase in cross-sectional area from its tail end to its nose end.

The means for channeling may include a recess in the tail end of the section, a cavity in the section, a baffle of relatively high resistance in the section, or at least one cut in the tail end of the section. Alternatively, the means for channeling may include embedments or compacts of elements with at least one dimension that is much smaller than the armature/projectile dimensions, which elements are made of material of relatively high resistivity or material of relatively high conductivity, for creating current paths in the section.

This invention also features a non-transitioning armature/projectile for a multi-turn rail gun that includes a nose, a tail, and a current carrying section between the nose and the tail including a plurality of discrete, current carrying stages aligned in the direction of motion of the armature/projectile. Each of these stages carries approximately the same amount of current for reducing the current concentration in the tail end of the section and distributing the current toward the nose. Preferably, the length of the stages generally decreases from the tail to the nose to generally increase the current density in the current carrying section from its tail end to its nose end. By making the length of the nth stage of the section counting back from the nose of the armature/projectile approximately the square root of n times the length of the stage closest to the nose, the electrically induced driving force and inertial force are essentially balanced, which removes internal stress in the current carrying section. However, there is generally no benefit in reducing the internal stresses and current density peaks below the level for avoiding material failures and/or damage to the payload.

The means for generally increasing the cross-sectional area of the current carrying section to reduce the current concentration in the tail may be formed by including a cavity in the section. Alternatively, the means for generally increasing may include at least one non current-carrying chamber for creating the increasing cross sectional area.

The current concentration in the tail may be reduced by separating the current carrying section into at least two discrete stages aligned in the direction of motion of the armature/projectile, the stage closer to the nose carrying approximately as much current as the stage closest to the tail. The section may alternatively include at least two discrete stages, which may be electrically connected in series or parallel, and may be aligned one on top of another and/or one ahead of another.

The length of the stages may be adjusted to generally decrease from the tail to the nose to generally increase the current density in the current carrying section from its tail end to its nose end. The length of the nth stage counting back from the nose is preferably approximately the square root of n times the length of the nose stage. The stages may be spaced from one another. The stages are typically insulated from one another, and are preferably interconnected by some means that may include a projectile passing through at least two of the stages. The armature/projectile may include a projectile protruding from the nose end of the section or a projectile protruding from the tail end of the section. The generally increasing current density may also be accomplished by providing stages which are all approximately the same length, but are spaced increasingly closer together from the tail to the nose of the armature/projectile.

At least two of the stages may carry approximately the same amount of current. At least one of the stages of the current carrying section may include a non current-carrying payload. This payload may extend through all of the stages. At least one of the stages may include means for channeling the course of the current through the stage for reducing the current concentration in the tail end of the stage to distribute the current in the stage toward its nose end. Preferably, each stage further includes means for providing electrical contact between it and only a single pair of rails of the rail gun. In addition, stages aligned in the direction of motion are preferably electrically connected in series; stages not so aligned are preferably electrically connected in parallel.

The armature/projectile may also include means for controlling rotation about its axis parallel to the direction of motion, to keep it in alignment with the rails and/or to impart angular momentum to it. This may be accomplished by including channels or protrusions in the contact surfaces of the section. The protrusions may be lobed. Either of these shapes preferably fit into complementary shaped protrusions and channels, respectively, in the bore of the rail gun. Alternatively, the armature/projectile may include means for conforming it to a profiled bore of the rail gun to impart angular momentum to it.

The armature/projectile may additionally include cuts made in its contact surfaces for providing compliance to the current carrying section which may reduce friction and contact resistance between it and the rails. The cuts may include an ablative material therein for enhancing plasma creation. The cuts may also include a lubricating material therein. These cuts may be transverse or parallel to the direction of motion or in any other direction, and may be relatively shallow or deep, or relatively narrow or wide to provide the desired compliance and contact resistance.

The stages of the armature/projectile may be interconnected by including matching, interlocking profiling of adjoining surfaces of adjacent stages. This profiling may include dove-tailing, or a lobe and channel design, for example. Adjacent stages are preferably insulated. In addition, at least two discrete stages may each include means for making electrical contact with one and the same pair of rails of the rail gun so that they are electrically in parallel. There may also be included means for interlocking these stages and/or stages making connection with different rail pairs which thus are electrically in series. This means for interlocking may be made releasable. The stages or stage sections may include means for attaching them to a projectile, which may or may not be current-carrying. These stages and stage sections can be formed to release the projectile on launching to allow the projectile to proceed unimpeded toward its target, and they may be mutually insulated.

Preferably, for use in a circular bore gun, the current carrying section is essentially rotationally symmetric about its longitudinal axis. Alternatively, the section may be essentially rectangular in cross section for use with a rectangular bore. In any case, preferably the current carrying section may include aluminum, magnesium, lithium and/or their alloys and may be twisted to impart angular momentum as it travels down the bore of a twisted-rail gun.

DESCRIPTION OF PREFERRED EMBODIMENTS

Other objects, features and advantages will occur from the following description of preferred embodiments and the accompanying drawings, in which.

Figure 12A:
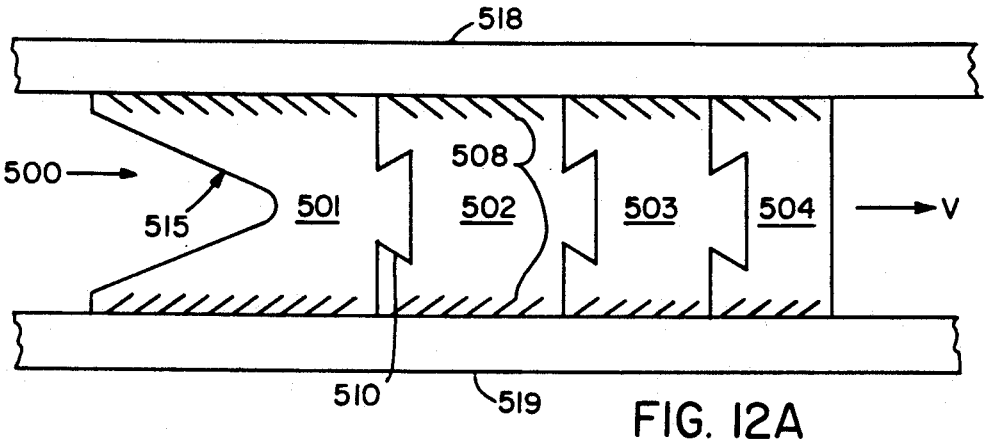
Figure 12B:
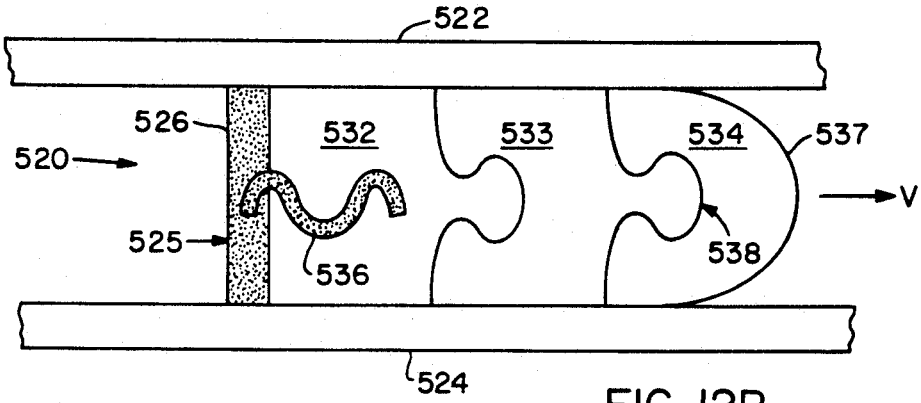
Figure 12C:
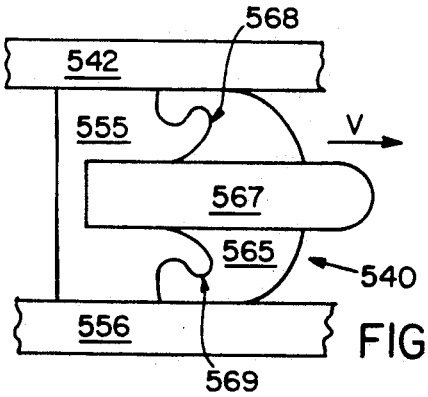

FIGS. 12A–C are diagrammatic views of geometries for joining stages together so as to form contouring tails in each stage forward of the tail stage.

Figure 12D:
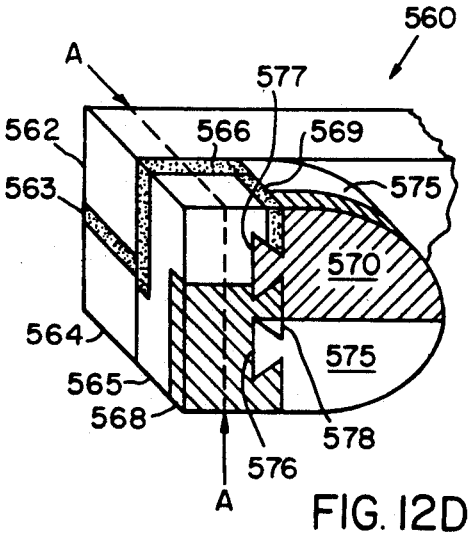
Figure 13A:
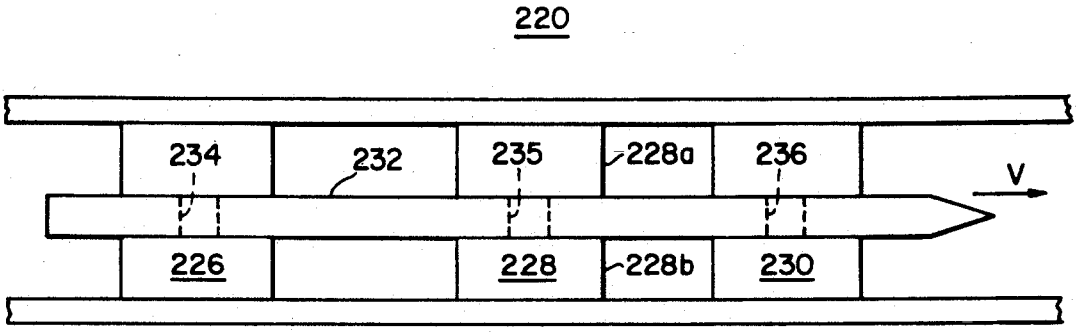
Figure 13B:
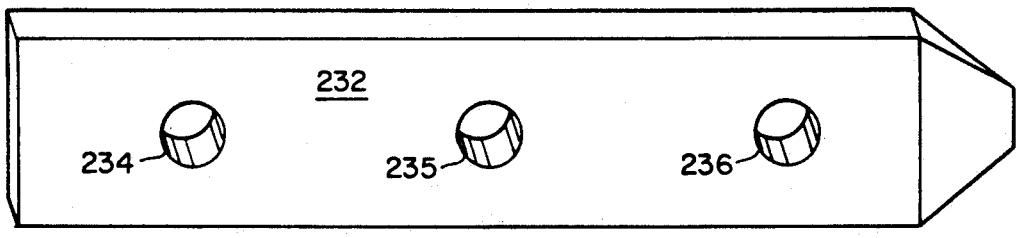
Figure 13C:
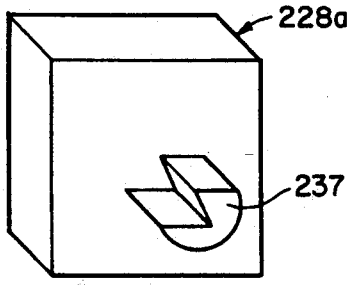
Figure 14A:
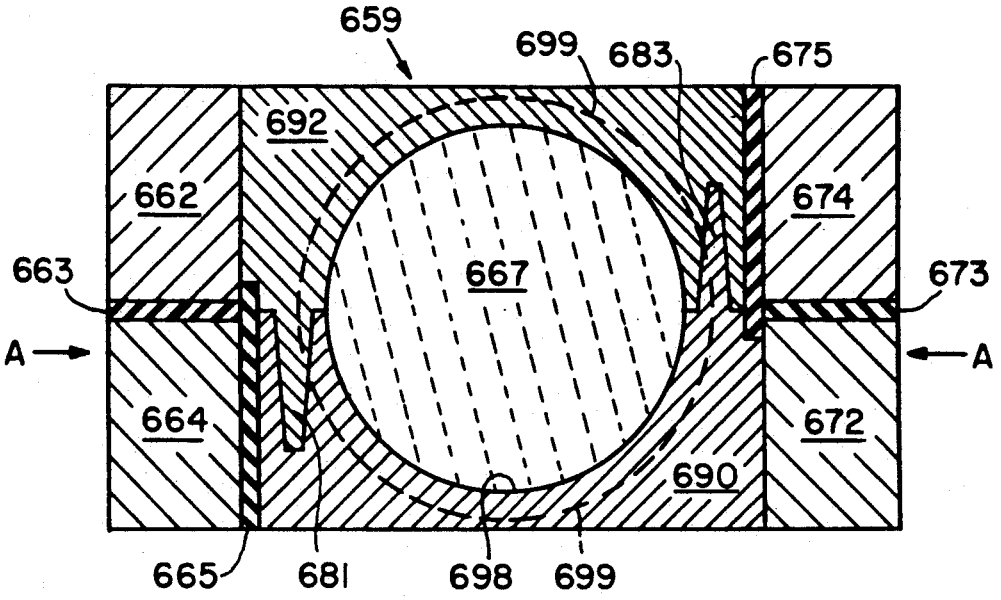
Figure 14B:
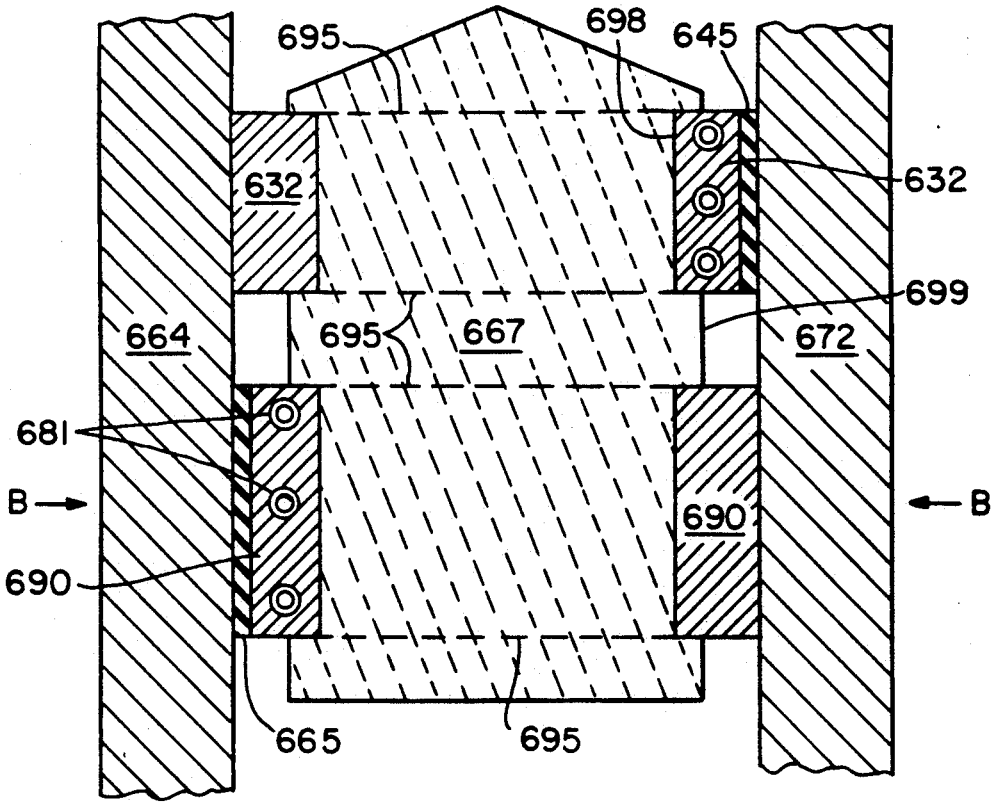
Figure 15B:
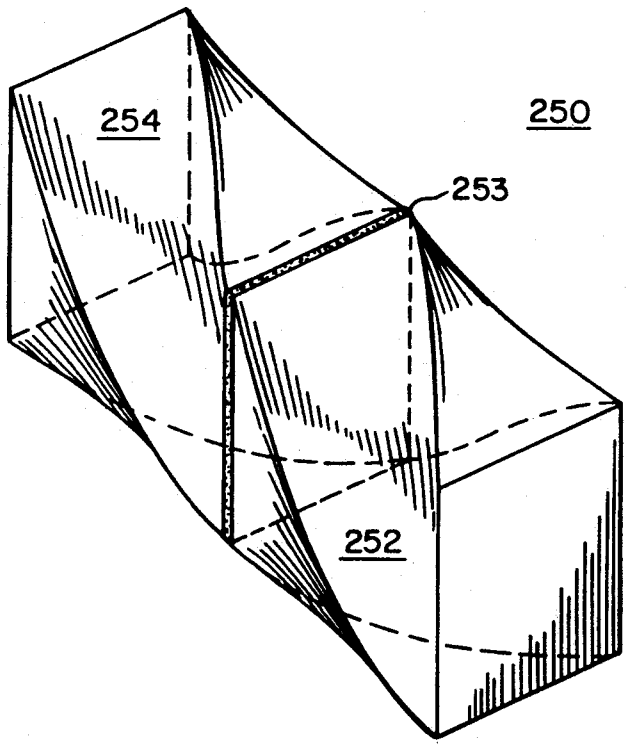
Figure 15A:
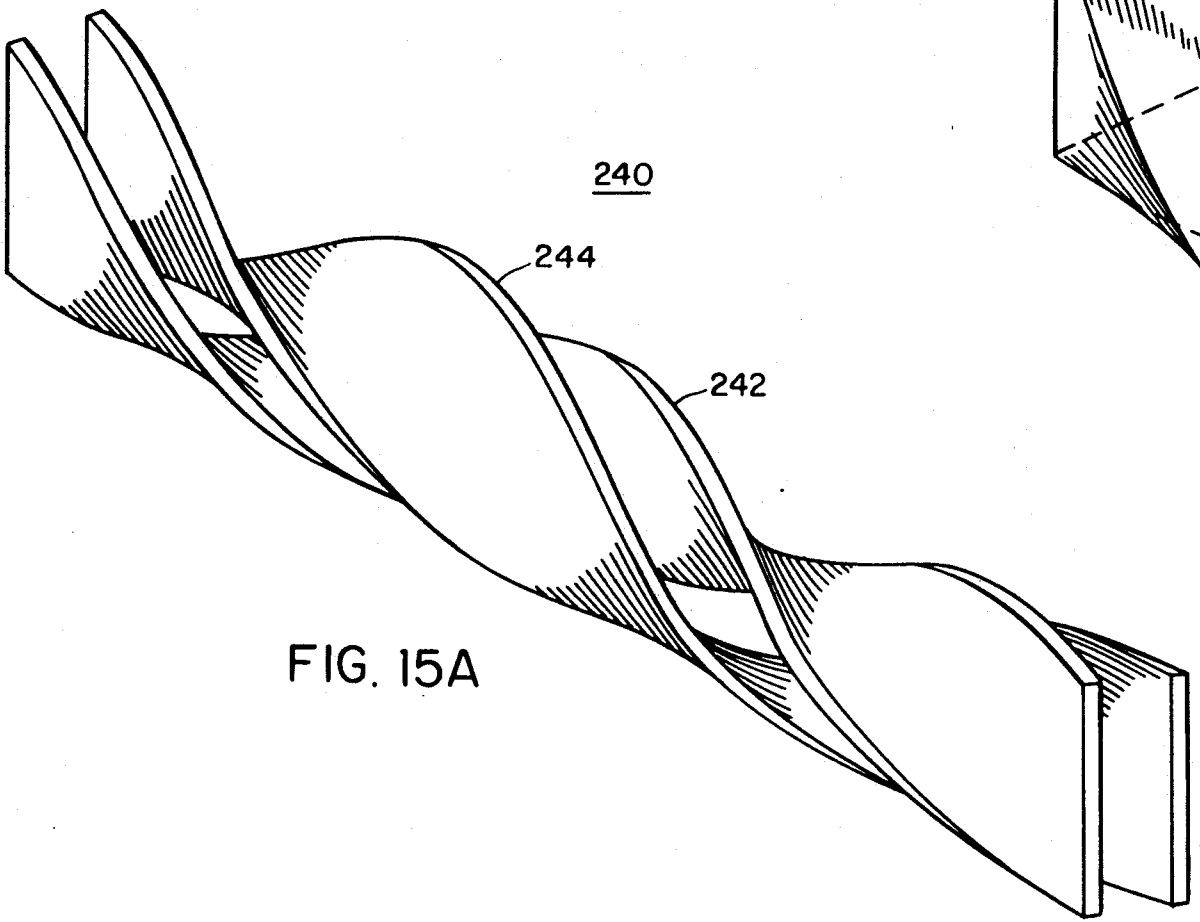

FIGS. 12D and E are axonometric and cross-sectional views of a two stage armature/projectile with stages joined as shown in FIG. 12A;

FIG. 13A is a diagrammatic view of yet another multi-stage armature/projectile according to this invention without a contouring tail;

FIG. 13B is an axonometric view of the projectile of FIG. 3A;

FIG. 13C is an axonometric view of a section of a stage of the armature/projectile of FIG. 13A showing the means for releasably attaching the stage sections to the projectile;

FIG. 14A is a diagrammatic view of the cross-section of an armature/projectile for a two-stage stacked rail gun in which each rail pair is electrically interconnected by two stages;

FIG. 14B is a diagrammatic view of a lengthwise cut along line A—A of FIG. 14A;

FIG. 15A is a diagrammatic view of the rails of a twisted rail gun for launching an armature/projectile with angular momentum according to this invention; and FIG. 15B is a twisted armature/projectile for launching by a rail gun of the type of FIG. 15A.

An non-transitioning armature/projectile for launching in a rail gun with at least one rail pair exposed to the bore of the gun according to this invention may be accomplished by providing discrete stages, each of which makes electrical connection between only the two rails of one rail pair. For a multi-turn armature/-projectile with more than one stage, the stages are typically arranged one ahead of another in the direction of motion. For a single stage armature/projectile, the stage is configured to cause the current to crowd toward the front, with a current density maximum preferably at a distance of at least one quarter of the length of the stage ahead of its tail. The current distribution can be accomplished by channeling the course of the current toward the nose, most simply by increasing the cross-sectional area from the tail to the nose. This current distribution will achieve a significant reduction of the mismatch between the spatial distributions of the inertial force and the electrical driving force which would exist even for uniformly distributed current in an armature/projectile, which normally can not occur due to the current skin effect. The reduction in the force mismatch causes a decrease in the internal stress at the rear end of the armature/projectile with the corresponding increased capability of the armature/projectile to withstand high accelerations.

The distribution of current flow lines caused by this armature/projectile configuration will further tend to reduce the severity of hot spots at the breech end of the surfaces of the armature/projectile where the current is conducted to and from the rails, which will reduce the probability of premature local melting, thereby extending the maximum allowable launch times and hence the final velocity. Since transitioning armatures must melt to be effective, this invention is directed only toward non-transitioning armatures in which the localized melting is at present a problem.

As a result of these effects singly or in combination, the maximum acceleration that can be imparted to the armature/projectile, the velocity achievable at a given barrel length, as well as the usable barrel length are increased as compared to the prior art, thus reducing the minimum rail gun barrel length required for achieving a predetermined armature/projectile speed as compared to the prior art. Additionally, for the same final velocity and otherwise comparable conditions, increased acceleration means a lowering of the electrical charge that must be supplied by the power source. This permits the use of lighter charge storage components compared to the prior art.

The armature/projectile may be a single or multi-stage armature/projectile for launching by a simple single turn rail gun or by a multi-turn augmented rail gun, or may be a multi-stage armature/projectile for launching by a multi-turn stacked rail gun. The armature/projectile may include stages in parallel aligned at approximately the same position in the gun bore and/or stages aligned in the direction of motion. These stages can be in parallel and/or in series.

In a stacked rail gun all rails are mutually electrically insulated except for the electrical connections between the two rails of each rail pair made by the armature/-projectile. Typically, one of each of the n pairs of rails is stacked together and the other of each pair of rails is stacked together separately to form the n-turn stacked rail gun. Alternatively, the rails can be all stacked together to form a stacked rail gun with an enclosed, typically circular bore. In either case, each rail includes a surface along the bore of the gun for feeding the current into or out of the armature/projectile. This can be accomplished through solid-solid sliding contact in the case of a solid armature, or through an intervening layer of plasma in a hybrid armature. Both types are non-transitioning armatures. Preferably, each pair of the n pairs of spaced, essentially parallel rails of the rail gun is conductively interconnected by at least one stage of the armature/projectile, but is not conductively connected to any other pair.

For an n-turn stacked rail gun the armature/projectile preferably includes at least n discrete, mutually electrically insulated stages generally aligned in the direction of motion. This provides a rail gun in which at least n stages are in series and, except for possible disturbances due to stray currents, each carries the full amount of current that is fed from outside into the rail gun. Alternatively, at least one of such stages may be replaced by two or more stages or stage sections which interconnect the same rail pair and thus are electrically in parallel. By means of stages aligned in the direction of motion, the current is channeled away from the tail of the armature/projectile and each stage is separately accelerated by the magnetic drive force of the current in the rail gun. As a result, the internal stresses in a multi-stage armature with at least two of the stages aligned in the direction of motion fired from a multi-stage stacked rail gun will always be much lower than in a prior art single or multi-stage armature/projectile of the same length.

The stages, connected in parallel, in a multi-stage armature/projectile fired from a simple rail gun or a multi-turn augmented rail gun, will be similarly separately accelerated except that the currents flowing through the gun may be unevenly shared among the stages. Similarly, if more than one stage is used to interconnect any one rail pair in a multi-stage stacked rail gun, the current in that rail pair is shared among these stages. Because armature/projectiles with multiple current-carrying stages aligned in the direction of motion launched from a stacked rail gun channel the current to distribute it along the armature/projectile, further measures to disperse the current within and/or among stages may not be required when at least two of the sections are aligned in the direction of motion.

While the stages of a multi-stage armature-projectile according to the present invention will be typically aligned in the direction of motion, it will in some cases be useful to choose different arrangements. For example, two or more stages for launching in a single-turn or multi-turn gun may be disposed at the same distance from the tail of the armature/projectile to jointly apply accelerating force to a payload, for example a projectile. If these stages conductively interconnect the same rail pair, they are thereby themselves conductively connected, even if within the armature/projectile they are insulated from each other. Stages not interconnecting the same rail pair must be mutually insulated, however, since otherwise stray currents can bypass one or more turns of a stacked rail gun. Stages which jointly apply accelerating force to a projectile or other payload can be arranged to release the payload at the end of the launch or soon thereafter to allow the payload to proceed on its mission unimpeded.

In order to reduce the probability of the kind of spalling which has been encountered with laminated armatures of graded electrical resistivity according to the prior art, the stages or sections can be mechanically interlocked, for example by means of profiling or dovetailing the stages to each other or to other non-current-carrying parts. Other means for joining, such as screwing, gluing, shock-welding, or diffusion bonding can also be used, either alone or together with the mechanical interlocking to prevent armature/projectile pieces from spalling off.

Preferably, such mechanical interlocking can be accomplished in a manner that also provides stages with the equivalent of contouring tails in accordance with the present invention. such designs effect current flow line crowding ahead of the tail end of the stages, with a corresponding lowering of internal stresses. Preferably, therefore, the interfaces between adjoining stages are curved or have other non-planar geometries. Such breadth of interconnecting and interlocking choices is especially desirable because of the large forces acting on and within armature/projectiles, including those due to shock waves besides the Lorenz and inertial forces already considered. As a result of the different origin of the stresses, and the fact that in armature/projectiles with distributed currents the Lorenz forces may have locally different directions, internal stresses may not be simply uniaxial along the longitudinal axis of the armature-projectile. Thus, the increased bond strength from mechanical interlocking of armature/projectile sections or stages may be even more important for embodiments with distributed current.

By providing a plurality of current-carrying stages generally aligned in the direction of motion of the armature/projectile, the internal forces are greatly reduced because of the current distribution, but are not completely eliminated even in the ideal case of uniform mass distribution and current flow normal to the rail surfaces everywhere. Rather, a uniform current density in an armature/projectile of uniform density still leaves internal stresses, which can be eliminated only by further distributing the current so that the current density actually increases from the tail to nose.

For uniformly distributed mass in an n-stage armature/projectile with the stages aligned in the direction of motion for launching in an n-turn stacked rail gun under idealized conditions, the tailored current density required for the elimination of internal stresses can be accomplished by providing stages with lengths that generally decrease from the tail to the nose. Preferably, counting back from the nose of the armature/-projectile, the length of the nth stage from the nose is approximately the square root of n times the length of the stage proximate the nose, or nose stage. For example, the stage behind the nose stage is approximately 1.4 times the length of the nose stage, and the next stage behind this stage is approximately 1.7 times the length of the nose stage. This will reduce the internal stress well below the stress level from uniformly distributing the current.

Rather than joining the current-carrying parts of the stages together directly, all of the stages can be interconnected by a non current-carrying projectile that passes through them. One or more of the stages may alternatively be designed to carry some type of payload. This payload may be a projectile embedded in one or more stages, a projectile passing through all of the stages, or some other type of payload, for example fuel or an explosive charge. The projectile may protrude from the nose and/or tail of the armature/projectile for aerodynamic stability. The armature/projectile may be further stabilized by either rifling the bore of the rail gun and conforming the armature/projectile to the rifling lands, or generally providing matched profiling between the gun bore and armature/projectile, or else twisting the rail gun and making the armature/projectile twisted to impart angular momentum to the armature/projectile.

In connection with a payload whose mass is essentially uniformly distributed over the length of the armature/projectile and which generates the major part of the inertial force but does not contribute to the current conduction between the rails, a current density distribution that is increasing from the tail to the nose can alternatively be accomplished by including current-carrying parts that are each approximately the same length, but spaced increasingly closer together from the tail to the nose. If the current carrying parts of the stages are spaced increasingly closer together from the tail to the nose of the armature/projectile, the average current density in the armature/projectile will generally increase from the tail to the nose as desired.

The same principle may also be applied to non-uniform distributions of mass along the armature/-projectile, including both the current-carrying parts and the parts which do not carry current. In that case, the current-carrying parts in each of the stages must be spaced so that the distance between their breech ends increases from nose to tail more rapidly, by the factor of the square root of n, divided into the accelerated masses, such as to be inversely proportional to the mass of the respective section of the armature/projectile. In other words, the current density must still increase by the root of k as compared to the inverse mass of the section of the armature/projectile accelerated to provide a magnetic field with a strength that balances the inertial force along the length of the armature/projectile. As a result, tailoring current density so that the Lorenz force matches the inertial force for any mass distribution may be accomplished.

As a result of the partial or complete elimination of internal stress by distributing current in accordance with the present invention, the armature/projectile can be accelerated to useful velocities over a much shorter rail length than in the prior art, thereby allowing rail guns for launching armature/projectiles to be made much shorter and/or armature/projectiles to be made much longer than the prior art allows. In particular, a multi-stage armature/projectile with stages aligned in the direction of motion for launching in a multi-stage stacked rail gun in accordance with the present invention can be accelerated by a greatly reduced current over much shorter rails and with greatly decreased requirements of stored electrical charge, with the attendant decrease in weight and cost of external current leads, gun and charge storage devices. Additionally, a stacked or augmented rail gun has a much greater self-inductance, which translates into a great savings, if not the total elimination of, the external self-inductances that are typically required in the prior art.

These advantages singly and in combination will strongly increase the applicability of rail guns as practical earth or spaced-based weapons and launchers. For example, on the basis of the elimination of internal stresses in the armature/projectile to the point that the strength of the rail material becomes the limiting factor in rail gun performance, and assuming $2\times10^9$ N/m$^2$ barrel pressure can be achieved, a 2 kg armature/-projectile according to the present invention could be launched at 10 km/sec from a 10 meter rail gun while a prior art armature/projectile would require a 22.5 m barrel length. If made with four stages and launched from a four-turn stacked rail gun, the armature according to the present invention would require a 0.002 second current pulse of $5.3\times10^6$ amperes, entailing a discharge of 4000 coulombs. A similar prior art armature/-projectile would require a discharge of 24,000 coulombs.

The effect that current crowding ahead of the breech end according to the present invention has of reducing bulk armature/projectile heating is somewhat independent of the effect it has of reducing internal stresses. The benefits of reducing bulk heating are much harder to quantify than those of reducing internal stress, but they can also be very important. The reduction in bulk heating is at least partly responsible for the success obtained with single-stage armature/projectiles designed in accordance with the present invention. These armature/-projectiles, having simple shapes with a contouring tail to obtain the crowding of current flow lines ahead of the breech end in accordance with the present invention, have been experimentally found to have been accelerated to speeds in excess of 2 km/se over a 1 m barrel length.

There is no known record of prior art armature/-projectiles to have been accelerated intact to speeds above 2 km/sec. In fact, the evidence available so far indicates that transitioning armatures can not be accelerated to velocities above 1.1 km/sec.

To promote the formation of plasmas at the rail interfaces in the case of hybrid armature/projectiles and/or to reduce gas friction, the armature/projectile may include channels in its surfaces facing the rails and/or the insulators. The armature/projectile may also include protruding sections that are preferably lobed and match corresponding grooves in the rails to control rotations of the armature/projectile and, in the case of hybrid armatures, to reduce stray current conduction between rails of the same polarity.

The armature/projectile may also include cuts made in its surfaces facing the bore of the rail gun to provide compliance between it and the rails to control the combination of normal force and interfacial resistance between the armature/projectile and the rails. Also, the extra surface area generated by the cuts can provide ions for the plasmas for driving hybrid armatures. Alternatively, lubricants and materials which release desirable ions can be filled into the cuts. These cuts may be made parallel to the direction of motion or transverse thereto, or at some intermediate direction, not necessarily all parallel, or may be made in more than one direction on any one surface area resulting in surfaces with pre-determined mechanical compliance.

The armature/projectile according to this invention may be made virtually any shape. Preferably, the current carrying section has an essentially rectangular cross-section typically square or else such that the distance between the surfaces facing the rails is smaller than those at right angles thereto. The latter shape provides a larger conduction cross-sectional area and a shorter current path for lower bulk joule heating. Alternatively, the armature/projectile and/or the current carrying section can be essentially rotationally symmetric for launching by a rail gun with an essentially round bore.

The current-carrying parts of the armature/projectile can be made from a variety of materials. The important considerations for their selection include a low ratio of electrical resistivity to specific heat, good strength, low enough hardness that they do as little rail damage as possible, low density in order to keep parasitic mass low, and preselected melting temperature and dependence of strength on temperature. In addition, material properties pertaining to the ease with which the materials provide ions for a plasma in case of hybrid armatures, and how fast a plasma generated by them moves under specified conditions may also be important. It is typically desirable that the current-carrying armature/-projectile materials that are exposed at the surfaces have as small a tendency to form alloys with the rail material as may be possible. In connection with rails whose surfaces are of copper or copper alloys, preferred current-carrying armature/projectile materials include aluminum and aluminum alloys, magnesium and magnesium alloys, and preferably include lithium.

Current distribution within any stage of the armature/projectile according to the present invention may be accomplished by providing an armature/projectile with a shape that channels the current to distribute it through the armature/projectile in a desired manner. Preferably, a shaped or contouring tail which typically but not necessarily has a cross-sectional area which generally increases from the breech end of the stage forward will accomplish the desired current channeling. This is especially useful in single-stage armature/-projectiles.

A contouring tail is defined as a configuration of the breech end of an armature/projectile which effects the desired current channeling or crowding of current flow lines ahead of the point closest to the breech at which current is designed to enter or leave the armature/-projectile. The contouring tail configuration is made up of the external surfaces which define the breech end of the armature/projectile and the surfaces intersecting these, whether they may define cavities or have inclusions embedded in the stage. Beyond any contouring or non-contouring tail, a current-carrying cross-sectional area which generally increases from the breech end of the armature to its muzzle end that moves current flow lines towards the muzzle end of the stage may be accomplished by including non current-carrying chambers. Preferably, at least one of the chambers is made from a payload, which may be non current-carrying, molded into the armature/projectile to provide contouring of the flow lines.

Alternatively, current distribution in an armature/-projectile according to the present invention may be accomplished by channeling the current in the direction of the surfaces of compacted or embedded elements, such as stacks of foils or bundles of fibers or other shapes whose smallest dimension is much smaller than both their length and the characteristic dimensions of the armature/projectile. These elements alter the conductivity of the current carrying part of the armature/-projectile to channel the current as desired. Examples would be fibers of circular cross-section whose diameter is much smaller than the diameter of the armature/-projectile or very slender tubing, or strips of foil, or foils whose width may compare with the dimensions of the armature/projectile. Alternatively, foils of any width in which additional surfaces are generated through cuts with at least one termination in the foil, or foils which are scored without cutting through them may be employed. Such channeling may be accomplished with elements with at least one relatively small dimension made of a material whose electrical resistivity is substantially higher than the electrical resistivity of the remainder of the current-carying part of the armature/projectile, for example carbon fibers embedded in a metal matrix. Current channeling may be also be accomplished through such elements made of highly conductive material which are separated by insulating films or by other relatively poorly conducting material. An example would be compacted aluminum or magnesium filaments or foils whose natural surface films provide partial insulation.

Another method of channeling to achieve a predetermined desired current distribution is through the embedding of relatively poorly or non-conducting material in the current-carrying parts in shapes having at least two dimensions that are comparable to the dimensions of the respective stages into which they are implanted. These act as physical current constraints or baffles. For example, the current flow lines in a rectangled single-stage armature/projectile made of a homogeneous metal could be channeled to crowd it at any desired distance ahead of the tail end by implanting a baffle in the form of a planar, insulating sheet of material into the midplane of the armature/projectile that extends the whole height parallel to the height of the rails, and extends forward from at or just ahead of the tail end to terminate somewhere within the armature/projectile. In this manner, the current flow-lines can be made to channel about the forward edge of the insulating sheet. Unless the rear-end of the implanted sheet intersects or coincides with the tail surface of the stage, such arrangement would not fall under the definition of the contouring tail. In addition, this arrangement would not affect the current-carrying cross section of the stage in the manner defined above.

One of the several advantages of current distribution or channeling through elements whose smallest dimension is small compared to the characteristic dimensions of the armature/projectile is that one need to add only moderately to the electrical resistance encountered by the current flowing from rail to rail across the armature/projectile to alter the current flow path. This is so because the electrical resistivity in the direction of the critical surfaces and/or current flow barriers in the form of scores in foils is substantially less than that in directions cutting across them, in which the electrical resistance is greatly increased. Extra electrical resistance from rail to rail of any armature/projectile stage on account of current channeling through embedded or compacted elements with at least one relatively small dimension is due to the longer path taken by the current flow lines, and to the reduction of the current-carrying cross-section through the presence of the insulating or lower conductivity material of the baffle. The bulk resistance may as a result be increased by a factor of approximately two, which is more than offset by the increased capability of the armature/projectile to withstand acceleration.

Similarly, the electrical resistance across the rails will only be moderately increased by implanting insulating shapes whose dimensions are comparable to the stage in which they are implanted. In the example of a baffle ending very near the tail surface of a rectangular single-stage armature/projectile, the resistance would be at most quadrupled and more likely be only doubled if the armature were cubical and the baffle extended through half the armature/projectile length. This increase is within acceptable limits.

Provided the smallest dimension is small compared to the dimensions of the armature/projectile, the individual element or particle of embedded material used for current channeling can have almost any cross section and shape, including a ribbon, sheet or tubular shape. Thus, it is not necessary that the third dimension be small compared to the length. For example, current may be channeled in a rectangled armature/projectile by means of folded strips of metal foil stacked together with or without cuts or scores. Also, it is not necessary that the cross section of the elongated shapes be constant over their length, nor that they be straight; they may be curved, coiled, corrugated or twisted.

In effecting a desired current distribution within any stage of a single or multiple-turn armature/projectile, any combination of current channeling means may be employed, including a contouring tail, compacted or embedded elements with at least one relatively small dimension, physical constraints such as baffles, tailoring the armature/projectile to effect a generally increasing current-carrying cross section from breech end to muzzle end, and controlling current flow lines through external shape, cavities, gaps and non-current carrying inclusions.

Independent of current channeling, use of more than one kind of current-carrying material in any one stage may be employed for additional purposes such as, for example, lowering cost, simplifying manufacture, improving bulk strength or strength of joints between different parts of the armature/projectile, and/or providing protective surface layers.

At the end of a launch, unwanted material may be stripped from projectiles or other payloads through the melting or thermal softening to some predetermined degree of materials with pre-selected melting temperature or temperature dependence of mechanical strength, or by physically releasing the payload. For example, current carrying parts may transmit the accelerating force to a projectile by means of sections passing through holes in that projectile and be dimensioned to melt near the end of the launch. Alternatively, such stripping may be accomplished mechanically. For example, stages may be interlocked or otherwise mechanically joined together and/or to the projectile using a geometry so that they transmit accelerative force to a projectile or other payload within the bore but are automatically released from each other and/or the payload after they leave the barrel.

Figure 1A:
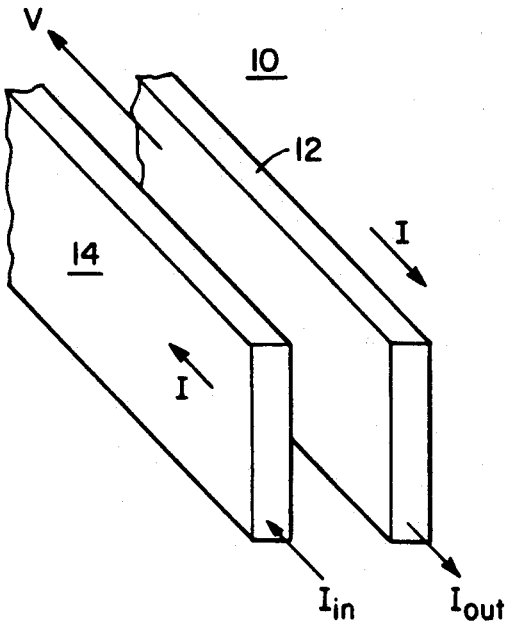
FIG. 1A PRIOR ART
FIG. 1A is a diagrammatic view of a prior art single-turn rail gun.

There is shown in FIG. 1A the arrangement of the rails in the simplest kind of prior art single-turn rail gun 10 with one pair of parallel, spaced rails 12 and 14. This can be operated with a plasma armature, i.e. an electrical current flow through ionized gas, or a transitioning armature which is designed to make sliding metal/metal contact with the rails until it melts, whereupon a plasma armature takes over. The armature may also be a non-transitioning solid or hybrid armature 16, FIG. 1B.

Figure 1B:
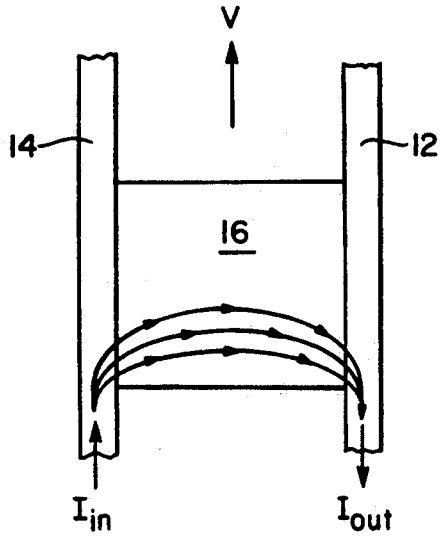
FIG. 1B PRIOR ART
FIG. 1B is a diagrammatic view of an armature for the rail gun of FIG. 1A showing the approximate pattern of current flow lines through the armature at the start of the launch.

Current flow is generally indicated by I, and will be done so in all of the figures. Velocity direction is indicated by V. The approximate distribution of current flow lines early on in a launch through armature 16 and adjoining rail sections is shown in FIG. 1B. Essentially, armature 16 is a solid block of metal, for example copper, aluminum, or silver, that slides between rails 12 and 14. In some applications the armature pushes a projectile or payload of non-conducting material ahead of it.

As shown by the arrows, the current flow lines through armature 16 tend to crowd in the breech or tail end of the armature, especially at the breech end of the armature—rail interfaces. This crowding is due to the current skin effect which arises because magnetic field lines require finite times to penetrate into conductors, and these times may be longer then the flight time of the armature in the barrel. Immediately after the onset of current flow, the indicated current flow line crowding is at its most severe. This causes uneven force distribution and localized heating that may destroy the armature.

The pressure of the magnetic field confined in the bore, formed by rails 12 and 14 and insulating spacers, not shown, exerts the accelerating force on the current-carrying armature 16. In a metal, that force acts principally on the charge carriers in the current flow, i.e. the electrons, whereas the inertial forces that cause the armature to resist acceleration operate on each mass element of the armature in proportion to the magnitude of the mass. The resulting mismatch between the spatial distributions of the accelerating (Lorenz) forces and the inertial forces causes internal stresses in the armature that may exceed its material fracture strength.

Figure 1C:
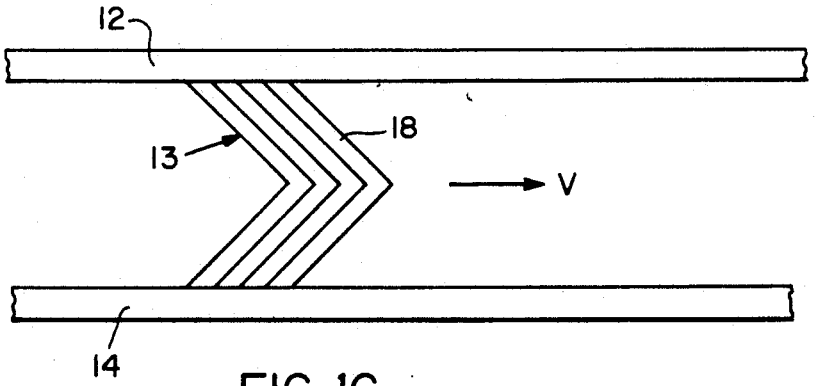
FIG. 1C PRIOR ART
FIG. 1C is a diagrammatic view of a prior art armature of the chevron type.
Figure 1D:
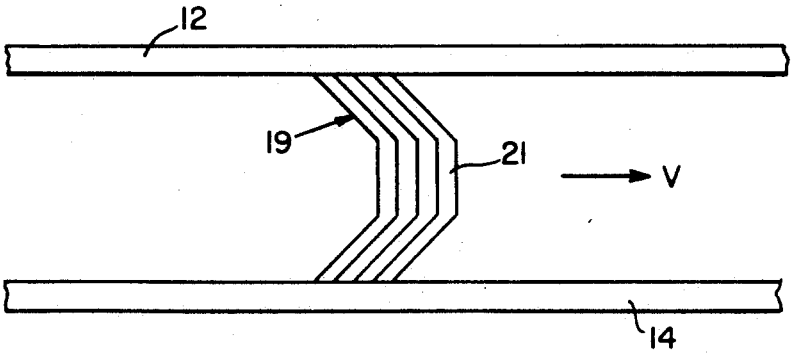
FIG. 1D PRIOR ART
FIG. 1D is a diagrammatic view of another prior art armature of the chevron type.

FIG. 1C is a cross-section through a prior-art chevron-type armature 13. Armature 13 is composed of a stack of geometrically similar pieces 18 of chevron shape. They are held together by some means, not shown. The electrical conductivities of the leaves can be graded in accordance with U.S. Pat. No. 4,430,921 with the intent of distributing the current somewhat evenly among the stages. In practice this not been successful because the current continues to be strongly concentrated in the stage or leaf closest to the breech, which causes it to spall off. FIG. 1D is a variant of the armature of FIG. 1C with the stacked stages 21 bent twice instead of once, but exhibits the same destructive spalling problem.

Figure 2:
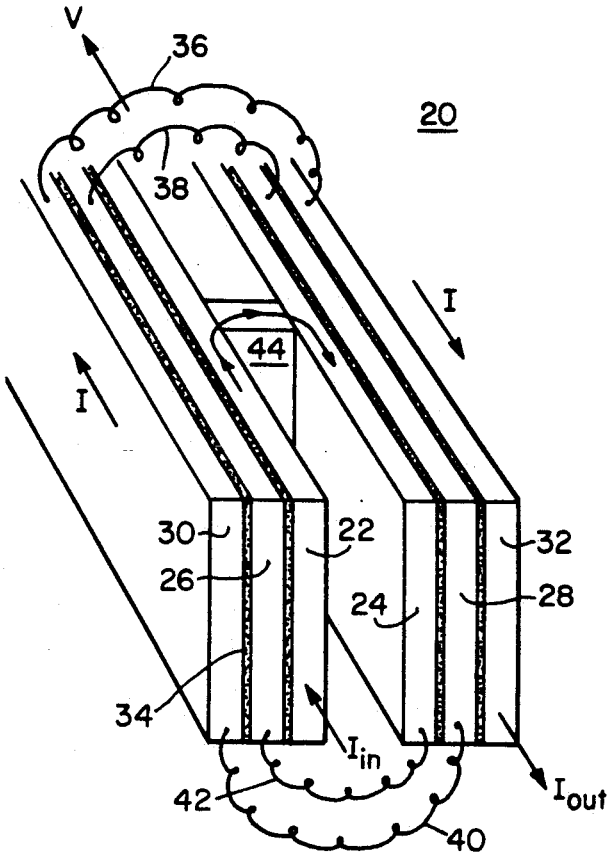
FIG. 2 PRIOR ART
FIG. 2 is a diagrammatic view of a prior art augmented rail gun.

A prior art three-turn augmented rail gun is shown in FIG. 2. Rail gun 20 includes three sets of parallel rails that are insulated by insulation layers such as layer 34. Rails 22 and 24 form the inside contact rails. Together with strips of insulating material which space the rails for mechanical strength, not shown, rails 22 and 24 form the bore of rail gun 20. They constitute the only rail pair which is directly electrically interconnected by armature 44. Armature 44, the middle set of rails, 26 and 28, and the outer set, 30 and 32, each carry the same current that also passes through rails 22 and 24 between their breech ends and armature 44. In use, current enters inside rail 22, passes through armature 44, and flows back down rail 24. The current is then passed to rail 26 by lead 42, to rail 28 by lead 38 at the muzzle end, and through lead 40 to rail 30. Lead 36 passes the current from rail 30 to rail 32 at the muzzle end, and the current exits from rail 32. All of the rails contribute to the magnetic field in the gun, but unlike the simple or one-turn gun of FIG. 1 a strong magnetic field is also established ahead of the armature instead of only behind it. Since magnetic flux density decreases with distance, the rails contribute increasingly less to the magnetic flux density in the bore as their distance from the bore increases. In other words, the rail pair formed of rails 30 and 32 contributes less than rail pair 26 and 28. Any of the armatures shown in FIG. 1 can be fired from the augmented gun, as can a plasma armature.

Figure 3:
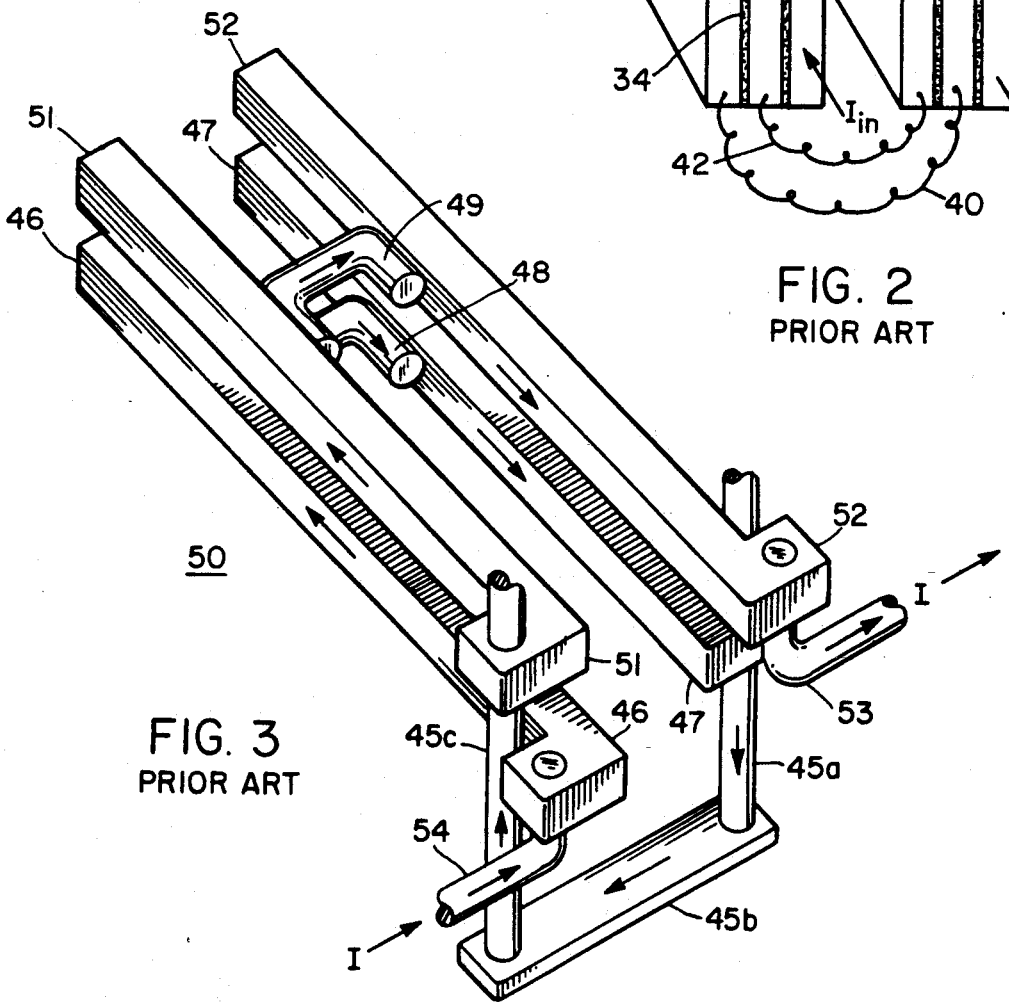
FIG. 3 PRIOR ART
FIG. 3 is a diagrammatic view of a prior art two-turn stacked rail gun.

A prior art two-turn stacked rail gun 50 is shown in FIG. 3. Rails 46 and 47 constitute the first rail pair of gun 50, and rails 51 and 52 the second pair. The rails form two stacks, one made up of rails 46 and 51, the other of rails 47 and 52. In actual construction the rails within each stack are separated by layers of insulating material, and the two stacks are spaced by insulating material. Those insulating components together with rails 46, 47, 51 and 52 form the bore which will in practice be very tightly closed on the four long sides and is mechanically very strong in order to withstand the high pressure during launch.

The armature consists of two stages 48 and 49 which are basically "C" shaped. Stages 48 and 49 must not melt, since otherwise current passes through the ensuing plasma armature directly from rail 46 to 52. Armature stages 48 and 49 are stacked on top of each other at right angles to the direction of motion.

In actual construction, stages 48 and 49 are molded together in an insulating material to make one rigid piece. The current enters rail 46 through lead 54, passes up rail 46 to armature stage 48, through it and down rail 47. At the breech end of rail 47 the current passes through three-piece connector 45 made up of post **45*a*, flat piece 45*b* and post 45*c* into rail 51. Connector 45 is electrically insulated from rails 46 and 52. Next the current passes up rail 51 to armature stage 49 and down rail 52 out of the gun through lead 53**. Since this stacked armature does not distribute the current toward the nose, it does not help balance internal forces and so can not be accelerated any more quickly than other prior art armatures.

Figure 4A:
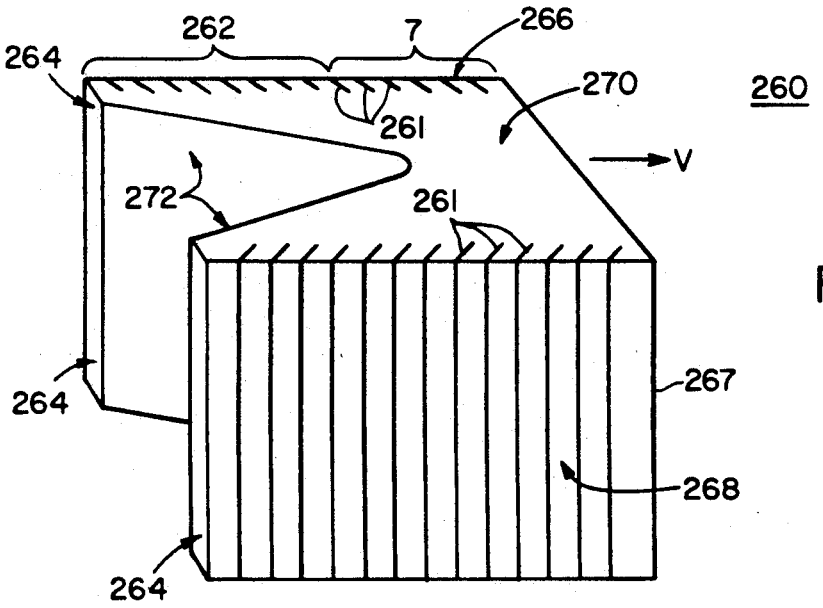
FIG. 4A is a diagrammatic view of a single-stage armature/projectile with a contouring tail for launching in a rectangled bore according to this invention.
Figure 4B:
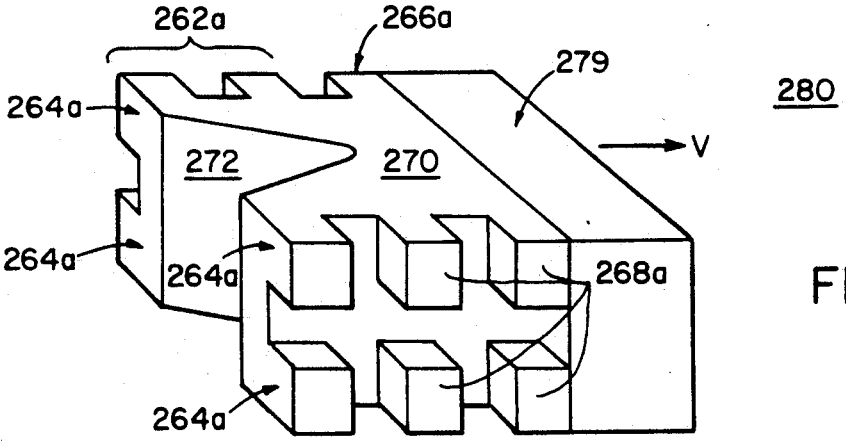
FIG. 4B is a diagrammatic view of a modification of the armature/projectile of FIG. 4A including a payload.
Figure 4C:
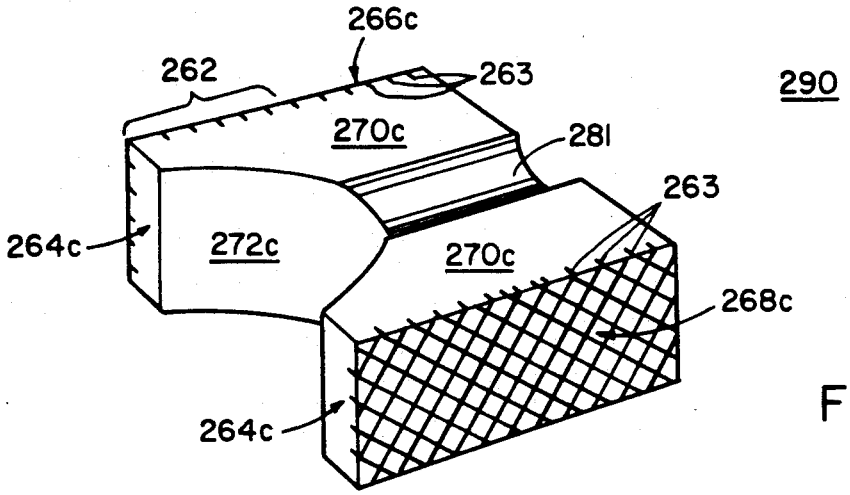
FIG. 4C is a diagrammatic view of another modification of the armature/projectile of FIG. 4A including a channel for reducing gas friction.
Figure 4D:
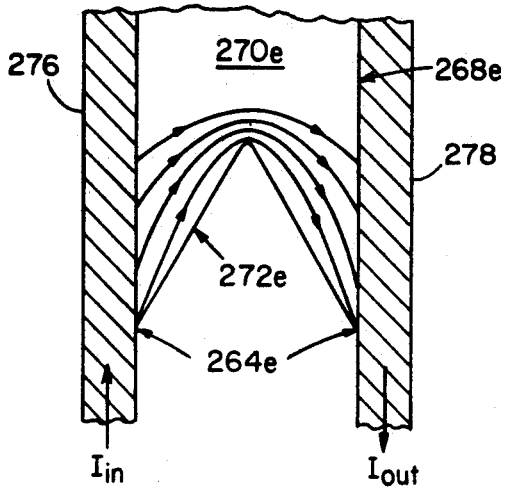
FIGS. 4D to 4G are diagrammatic views of approximate patterns of current flow lines at the start of launch about various examples of contouring tails of armature/projectile stages according to this invention.

Three modifications of an armature/projectile in accordance with the present invention are shown in FIGS. 4A, 4B and 4C. The decisive feature is contouring tail section 262 formed by surface 272. Contouring tail 262 channels the current toward the nose formed by surface 267 and crowds the current flow lines ahead of tail section 262 into nose section 7. End 264 is flat in this design and is at the same position along the rails as the edges of the current-conducting surfaces 266 and 268 facing the rails. Current flow lines early in the launch are qualitatively indicated in FIG. 4D.

Side 270 and the one parallel to it on the bottom of armature/projectile 260 slide along insulating spacers of the barrel. Surface 272, which forms the contoured tail, is optionally more rounded to reduce localized stresses that could crack the armature/projectile, especially when it leaves the barrel of the rail gun.

Vertical cuts 261 on surfaces 266 and 268 of armature/projectile 260, FIG. 4A, and multiple cuts 263 on surfaces **266*c* and 268*c* of armature/projectile 290**, FIG. 4C, permit adjusting the mechanical compliance to control the interfacial electrical resistance between the armature/projectile and the rails. Desired is an optimal compromise between heat evolution at launch through interfacial resistance, which decreases with the normal force between the armature and rails, and through friction, which increases with the normal force between the armature and rails. The cuts may be filled completely or partially with materials which promote ion formation for plasmas, such as lithium and lithium compounds. The cuts may similarly be filled partly or completely with materials meant to serve as lubricants, such as graphite or low temperature melting metals, or both types of materials may be used together.

A payload 279 is indicated only for armature/projectile 280, FIG. 4B, but armature/projectiles 260 and 290 in FIGS. 4A and 4C could also carry similar payloads. The coarse cuts on surfaces 266*a* and 268*a* of armature/-projectile 280, FIG. 4B, leave these surfaces stiffer than the cuts on surfaces 266 and 268, FIG. 4A, and 266*c* and 268*c*, FIG. 4C.

Grooves such as groove 281, FIG. 4C, extending the length of surfaces 266*c*, 268*c* and/or 270*c*, and those formed by the coarse cuts on surfaces 266*a* and 268*a* of armature 280, FIG. 4B, can also be helpful to reduce resistance caused by gases in the barrel in front of the armature/projectiles.

Armature/projectiles 260, FIG. 4A, 280, FIG. 4B, and 290, FIG. 4C, are all non-transitioning armatures that are designed to convert from solid/solid sliding to action as hybrid armatures after only short sliding distances. That can be achieved by making surfaces 266 and 268 rather stiff, as, for example, by making no cuts at all, but rather profiling surfaces 266 and 268 as shown in armature/projectile 280, FIG. 4B. Alternatively, the cuts on surfaces 266 and 268 of armatures 260 and 290 in FIGS. 4A and 4C can be made rather shallow.

By contrast to these embodiments, the chevron-type armatures of FIGS. 1C and 1D are designed for solid-solid contact sliding as long as possible. However, the available evidence suggests the existence of a top speed limit on solid-solid sliding contact between 1 and 2 km/sec. In a series of experiments, armatures of types 260 and 280 with and without pay loads have been reproducibly accelerated to between 2 km/sec and 2.6 km/sec in a one-meter barrel length, as contrasted to the next highest reported speed of just below 2 km/sec with a solid cylindrical armature of the "fishbone" type. Top speeds in all other known experiments with non-plasma armatures of any type have remained well below 2 km/sec.

Figure 4E:
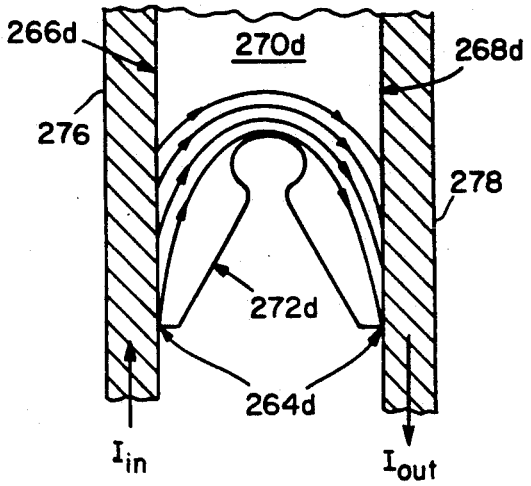
Figure 4F:
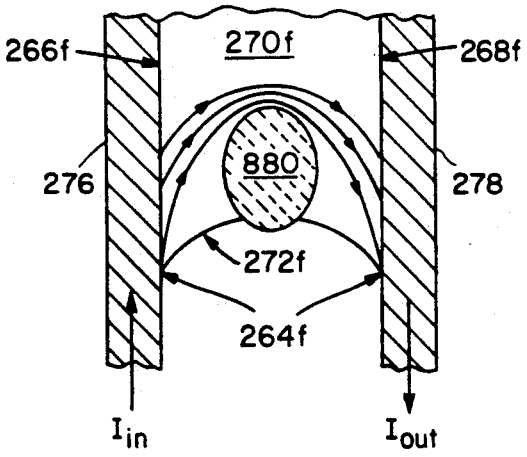
Figure 4G:
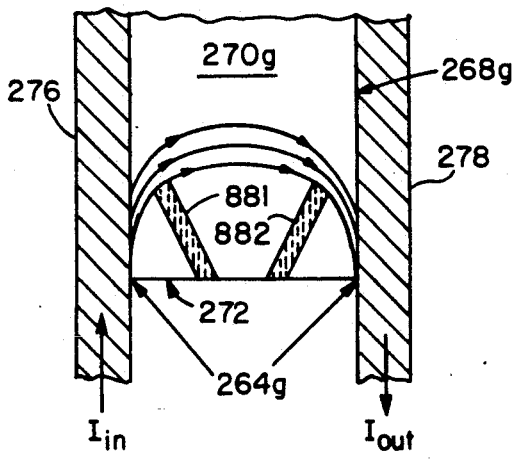

Many designs are possible for contouring tails besides the simple vee-cuts of armature/projectiles 260, 280, and 290 of FIGS. 4A to 4D. Three others are shown in FIGS. 4E, 4F and 4G. All of these embodiments could be made for rectangled as well as circular bores, and with appropriate non-major modifications for any other bore shape, for example a multi-faceted shape. In circular bores, additional cuts or other current deflecting means may have to be employed as further discussed in conjunction with FIG. 5.

The examples of FIGS. 4E to F are chosen to illustrate some of the basic possibilities in designing contouring tails. In FIG. 4E, part of surface 272*d* generating the contouring tail widens out to let the conductive cross-section of the armature first increase and then decrease forward of end-lines 264*d*. The result is the desired current flow line channeling according to the present invention. An application of this design will be seen in FIG. 12B.

FIG. 4F is an example of a contouring tail which has both an end surface 272*f* which by itself would cause current flow line channeling, and an implantation of an insulator 880 which in this case is in fact more effective than the curvature of tail surface 272*f*. Implantation 880 would preferably be rod-shaped for a rectangled bore and egg-shaped for a circular bore as shown. Alternatively, implantation 880 could be a cavity, a metal of lesser conductivity than the surrounding material, a pay load, or a metal of high conductivity surrounded by an insulating layer. Since the surface of implantation 880 meets tail surface 272*f*, it is part of the contouring tail, which would not be so if implantation 880 were displaced forward of tail surface 272*f*.

FIG. 4 G is an example of using more than one implantation, 881 and 882 to effect the current channeling. Preferably, the current is crowded at least 25% of the length of the armature/projectile from its tail. In addition, the crowding is preferably spaced at least 40% of the width of the armature/projectile from the nearest rail to keep localized heating to a minimum. In the case of a circular bore, 881 and 882 might be cuts through a cone-shaped single baffle. This example illustrates why it may on occasion be desirable to require that the current crowding peaks be displaced from the rails, since otherwise as much local heating might be generated at the leading ends of baffles 881 and 882, for example, as otherwise might happen at edges 264*f*. The same possibilities of exchanging cuts for baffles and for making baffles 881 and 882 of different materials exist as already described for baffle 880 of FIG. 4F.

In conjunction with rectangled bores, all of the designs in FIG. 4 can be readily adapted for use in multi-turn stacked rail guns. Additional modifications, as clarified in connection with FIGS. 5 and 9, would also make them usable for circular bores.

FIGS. 5A–5D show variants of the contouring tail design of FIGS. 4A to D, but for a single-turn rail gun with a circular bore. As seen in the lengthwise cut of FIG. 5A and cross-sectional cut FIG. 5B, the contouring tail of armature/projectile 79 formed by cavity 84 and at least two diametrically opposed cuts 89, only one shown, channels the current flow to distribute forward of tail end surface 82. Cuts 89 may be partly or completely replaced by implanted insulating material 83, FIG. 5D.

Figure 5A:
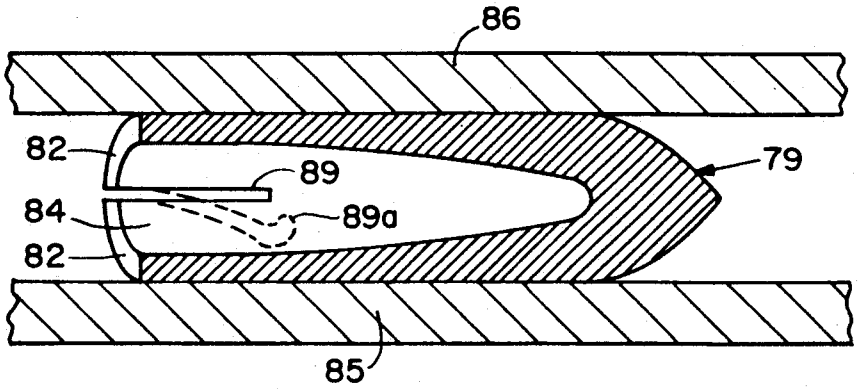
FIG. 5A is a lengthwise cut of a single stage armature/projectile with a contouring tail for launching in a circular bore according to this invention.
Figure 5D:
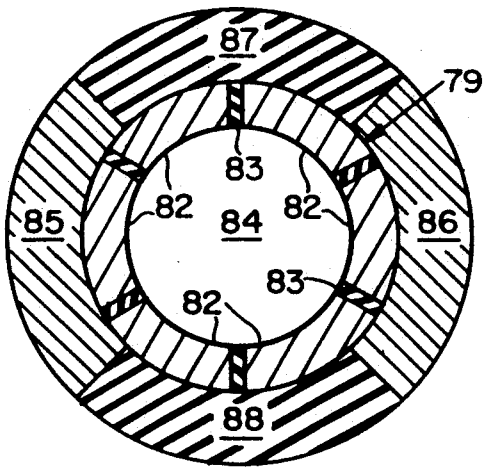
FIGS. 5B and 5D are cross-sectional views of variations of the armature/projectile of FIG. 5A.
Figure 5C:
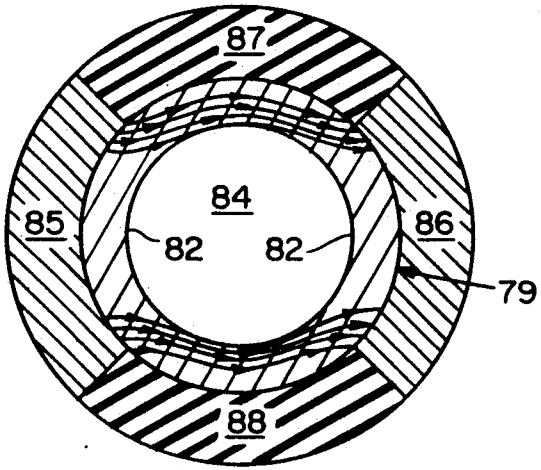
FIG. 5C depicts the approximate pattern of current flow lines that would arise at the start of launch in the armature/projectile of FIG. 5A without a contouring tail.

As shown by the approximate current flow line pattern in FIG. 5C, without cuts 89 or baffles 83, FIG. 5D, or other measures to properly distribute the current, for example through current channeling with embedded or compacted elements with at least one dimension relatively much smaller than the armature/projectile, the current flow lines in armature/projectile 79 at the start of the launch would curve about cavity 84 of the vee-tail at tail end surface 82, and would concentrate at the rail edges. Even so, the bending of the flow lines about the circumference of cavity 84 together with the increase of the conductive cross-section from tail end 82 forward caused by the generally conical cavity may provide enough current redistribution even without the cuts, depending on the contouring of cavity 84, and may make any further measures to distribute the current away from the rail edges unnecessary.

Figure 5B:
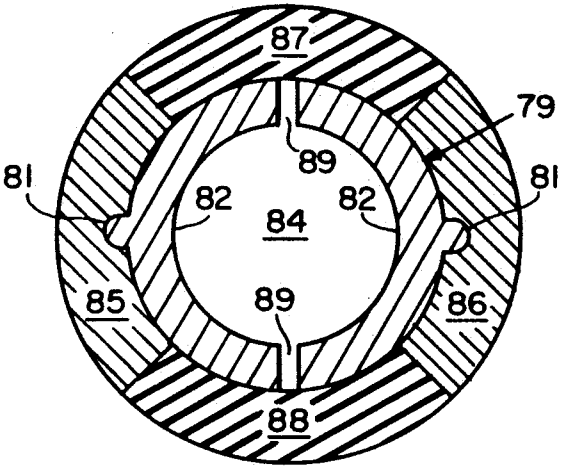

Two diametrically opposed cuts 89 in conjunction with one rail pair 85/86 and one correlated pair of insulators 87/88 each occupying a 90° sector as in FIG. 5B may not reliably effect the desired current channeling forward of tail end 82 if armature-projectile 79 can rotate relative to the rails by 45° or more about its length-wise axis. Such unreliable action of cuts 89 and/or baffles 83 can be prevented by decreasing the maximum arc length of uninterrupted tail-end surface 82 to less than the minimum arc length between insulators separating adjacent rails, for example by increasing the number of baffles 83 as shown in FIG. 5D.

Alternatively, rotations of the armature/projectile about its length-wise axis may be controlled by means of protrusions 81, FIG. 5B, on armature/projectile 79 that match corresponding channels in rails 85 and 86. Protrusion/channels 81 extend the whole length of rails 85 and 86 and the surfaces of armature/projectile 79 paralleling the rails. Protrusion/channels 81 are not necessarily straight. If protrusion/channels 81 have a spiral shape, they generate rifling which will impart angular momentum to the armature/projectile. Such rifling may be imposed on straight rails and thereby cause rotation of the armature/projectile relative to the rails. Alternatively, the rails may also be spiraled. In that case, the armature/projectile can be made to rotate about its length-wise axis while staying in the same angular orientation relative to the rails.

For use in conjunction with spiralling rails, or to effect other desired current distributions, cuts 89 and insulating baffles 83 may be generally curved. Also, they need not be parallel sided. Both of these modifications are illustrated by means of dashed lines 89*a*, FIG. 5A.

Many other arrangements for controlling rotations of the armature/projectile about its length-wise axis, either relative to the rails or while remaining in the same angular orientation relative to the rails, are possible. An example are lobes on the armature/projectile fitting into the corresponding profiles in the bore of the gun. In general, any profiling whose cross-sections on armature/projectile and gun bore are complementary will be suitable for the purpose of controlling rotation of the armature/projectile about its length-wise axis as desired, either to impart angular momentum or maintain a fixed position relative to the rails or both.

Figure 6A:
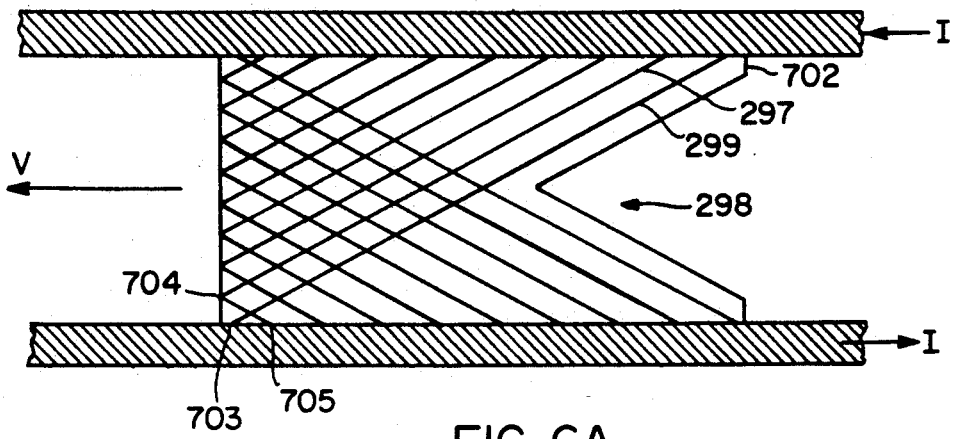
FIG. 6A illustrates current channeling through embedded or compacted elements in an armature/projectile of the type in FIG. 4A.

In FIG. 6A is shown a possible arrangement of embedded or compacted elements, such as fibers or foils, whose smallest dimension is much smaller than the dimensions of the armature/projectile, which would be suitable for channeling current in a rectangled vee-tail armature/projectile of the type in FIGS. 4A and 4C. This channeling would generate a current flow pattern very different from that in FIG. 4D. The current through armature/projectile 298 will be channeled from rail to rail along the indicated directions. For example, flow along line 299 will be from tail portion 702 to nose portion 703, and flow along line 297 is from an area just in front of tail end surface 702, up to nose 704 and back to side portion 705. Each current flow line comes close to the nose end 704 of armature/projectile 298 provided that the surfaces of the channeling elements are disposed along those same directions and cause the electrical resistivity of the armature/projectile to be much smaller in the long direction of the lines than at right angles thereto. This channels the current in the desired manner. Channeling may be achieved with elements made of a material having a considerably higher electrical resistivity than the surrounding matrix material, for example carbon fibers in a highly conducting metal, or with elements having a high electrical conductivity separated by material of much lower electrical conductivity, for example compacted metal foils or fibers with oxide films. If foils are used, the desired anisotropy could be generated or augmented with cuts or scores in the foil, at least one end of the cuts terminating within the foil.

The arrangement shown in FIG. 6A may generate additional internal stresses other than those normally occurring from currents traversing the armature/projectile more or less at right angles to the rails. Preferably, the indicated arrangement of embedded or compacted elements, if not directly made of planar foils, would be made by first forming sheets, which then would be stacked and bonded together in a manner which would give armature/projectile 298 enough internal strength to keep from spalling as a result of the internal stresses.

Figure 6B:
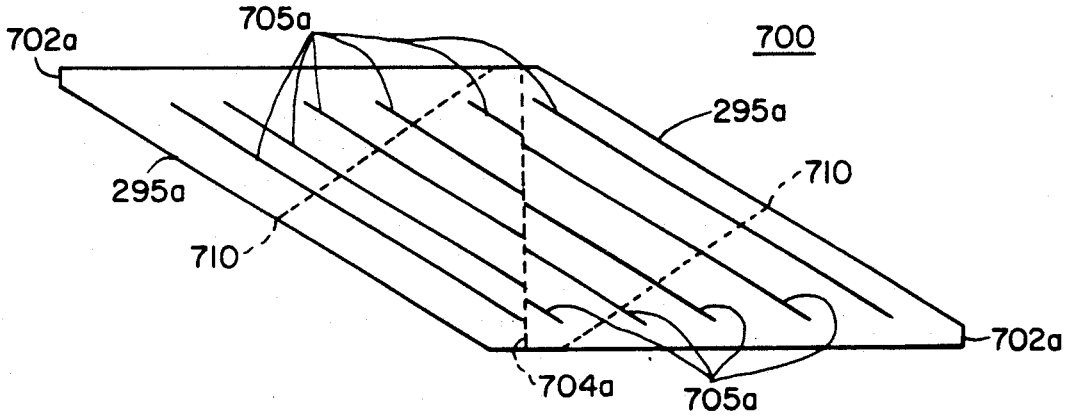
FIG. 6B illustrates one foil layer for forming the armature/projectile of FIG. 6A.

FIG. 6B shows an example of using planar foils to channel the current. Metal foil 700 is scored or cut along lines 705*a*, and then folded along dashed line 704*a*. Surface 704*a* then forms part of nose 704, FIG. 6A. End surfaces 702*a* form part of end surface 702, and sides 295*a* form part of tail surface 295. By making foil 700 only one-half as thick between dashed lines 710 as it is outside of those lines, when the foil is folded its thickness will be uniform. A number of folded sheets could be bonded to form an armature/projectile of the type shown in FIG. 4A by pinning the sheets together parallel to the running surfaces 266 and 268, FIG. 4A.

Figure 7:
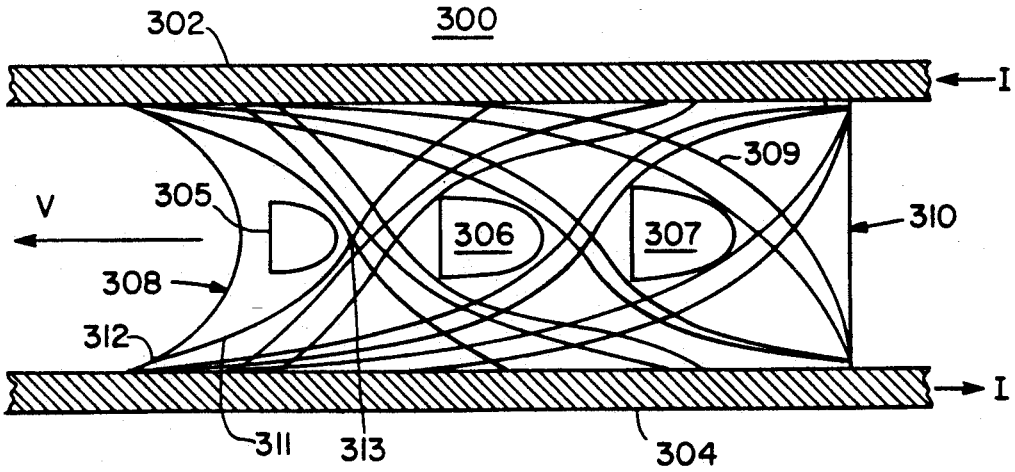
FIG. 7 illustrates current channeling through embedded or compacted elements such as foils or fibers with at least one small dimension, and an altered cross-sectional area in a single-stage armature/projectile without a contouring tail.

Another possible pattern of elements for current channeling is shown in FIG. 7. Armature/projectile 300, accelerated between rails 302 and 304, carries payload in the form of three separate inclusions 305, 306 and 307. If the inclusions essentially do not carry current, their size differential provides a generally increasing cross sectional area from tail to nose that helps to channel the current as desired. The bore in this case could be rectangular or cylindrical. In the former case, channeling elements 309 would preferably be arranged in planar sheets, as shown in FIGS. 6A and 6B, before being stacked and bonded together, but not all sheets would necessarily have the same patterning. In fact, though, all sheets could have the same pattern, for example that shown by line 311 from point 312 to point 313, which could be impressed on metal foils by scoring. For clarity, only a very small fraction of the sheets or fibers and their directions are indicated. The nose end 308 of armature/projectile 300 is convex, which increases the interfacial area between armature/projectile 300 and rails 302 and 304, thereby increasing the places at which current can be fed into and out of the armature/projectile. In the case of a circular bore, the pattern formed by surface directions of elements 309 could be effected with fibers which could be wound rather than stacked. The accelerating force of the magnetic field in the bore will act principally on the component of the current at right angles to the rails. Preferably, the current is channeled so that the effective current density at right angles to the bore increases from tail end 310 to nose 308. In any case, no contouring tail would be required with armature/projectile design 300, and none is indicated. Additional payload could be pushed ahead of armature/projectile 300.

Figure 8A:
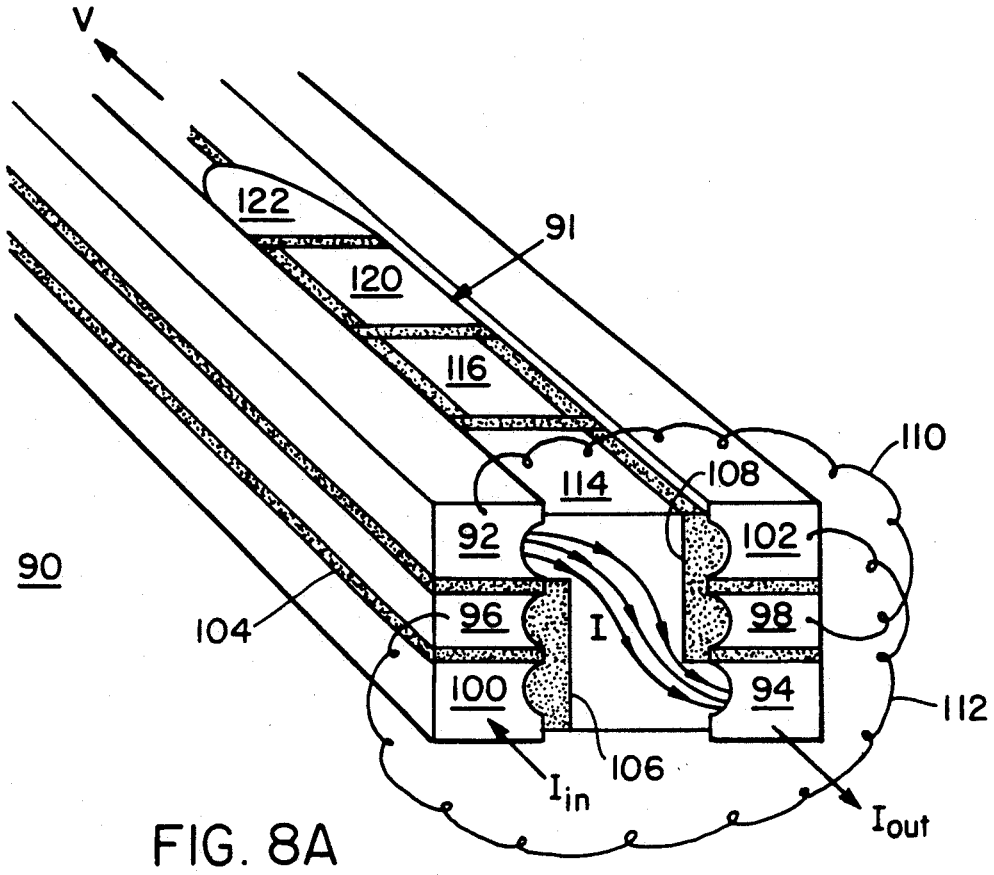
FIG. 8A is a diagrammatic view of a three-turn stacked rail gun and a three-stage armature/projectile for use in it according to the present invention.
Figure 8B:
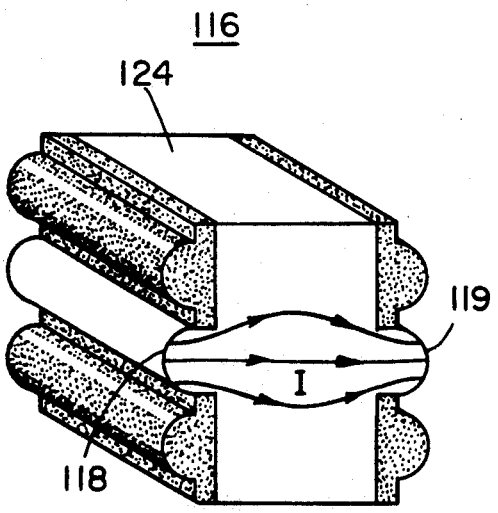
FIG. 8B and 8C are axonometric views of two stages of the armature/projectile of FIG. 8A.
Figure 8C:
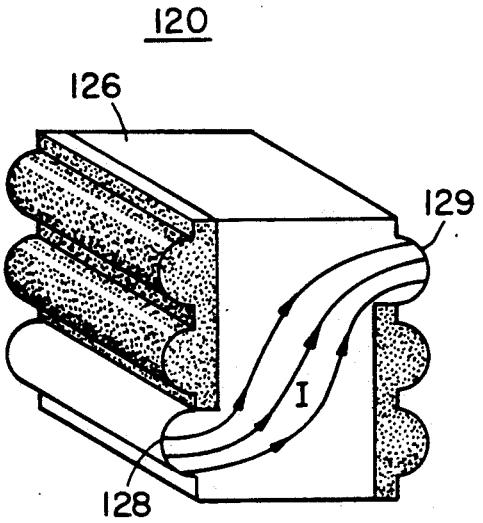

Three-turn stacked rail gun 90, FIG. 8A, operates on the same principle explained in connection with FIG. 3. Three-stage armature/projectile 91 includes current carrying stages 114, 116 and 120, and aerodynamic nose section 122 that does not carry current. The cross-hatched sections seen in FIGS. 8A, 8B and 8C are insulating sections that channel the current through each stage of armature/projectile 91 and through the rail pairs of the stacked-rail gun. These cross-hatched sections also prevent unwanted shorting between the rails.

Tail stage 114 is shown from the breech end in FIG. 8*a* and no contouring tail is indicated. This is done to keep the drawing simple but there is no reason why any of the designs of FIG. 4D to G could not be used, appropriately modified to take account of insulators 106 and 108. Insulating sections 106 and 108 keep stage 114 from electrically interconnecting rail pairs 100/102, and 96/98. Current flow through stage 114 is from rail 92 to 94. Stages 114, 116 and 120 all have lobed protruding sections fitting into matching channels in the rails for impeding unwanted current passage between different rail pairs if and when the armature/projectile operates in the hybrid mode, especially after some material has eroded from its surfaces.

Stages 116 and 120 are shown in detail in FIGS. 8B and 8C. Stage 116 includes current-carrying metallic portion 124 which is somewhat cross-shaped. Lobed sections 118 and 119 electrically interconnect the rails of rail pair 96/98 of FIG. 8A. Similarly, lobes 128 and 129 of conductor 126, FIG. 8C, electrically interconnect rails 100 and 102, FIG. 8A.

The current flows in series through three-stage rail gun 90 as follows. Current enters rail 100 and passes through stage 120 to rail 102. The current passes down and out of rail 102, through lead 112 and into rail 96. The current then passes along rail 96, through stage 116 and out through rail 98. The current is then moved through lead 110 to rail 92, through stage 114, and out rail 94. Thus, the total current passing through rail gun 90 passes through each stage of armature/projectile 91. As a result, rail gun 90 is a three-turn solenoid with turns tipped relative to each other about the lengthwise axis of rail gun 90. The current supplied from the outside can therefore be approximately reduced by a factor of three over a single turn rail gun to accelerate the armature/projectile to the same velocity over the same rail length. Alternatively, the connecting leads 110 and 112 as well as the insulations on stages 114 and 120 could be rearranged to let the current in stage 114 flow from rail 92 to 102 and in stage 120 from rail 100 to rail 94 to remove the relative misorientations among the current turns. That would probably lead to an increased rail gun efficiency but also to a potential increase of stray currents partially shorting the three turns.

In either case, the accelerating Lorenz force acts on stages 114, 116 and 120 with comparable strength instead of being essentially applied only at the tail end as it would be in a single-turn or augmented rail gun with a similarly shaped armature/projectile or a prior art multi-stage armature. As a result, the mismatch between the spatial distributions of the Lorenz force and the inertial forces is greatly reduced, which in turn permits application of higher accelerations for a shorter required barrel length at the same final velocity, or for a higher velocity at the same barrel length. Alternatively, for the same final velocity and barrel length, the aspect ratio of armature/projectile length to rail spacing could be increased.

Although the total armature/projectile current is equally distributed among the three sections as indicated, the Lorenz and inertial forces are not completely balanced. A more perfect overall balancing can be achieved, for more or less uniform mass distribution, by making stage 114 longer and stage 120 shorter than stage 116, so as to effect a generally increasing current density from breech end to muzzle end. On a finer scale, an improved balance between accelerating and inertial force can be attained by distributing the current within each of the stages by current channeling as described in connection with FIGS. 4 to 7, including a contouring tail, for example as shown in FIG. 12A and/or by implanting a baffle as shown in FIG. 12B. Alternatively, the mass of the stages can be adjusted to distribute the inertial force to better balance the Lorenz force from place to place, or these methods may be used in any combination to achieve a sufficient balancing to avoid damage or material failure within the armature/projectile during launch.

Figure 9:
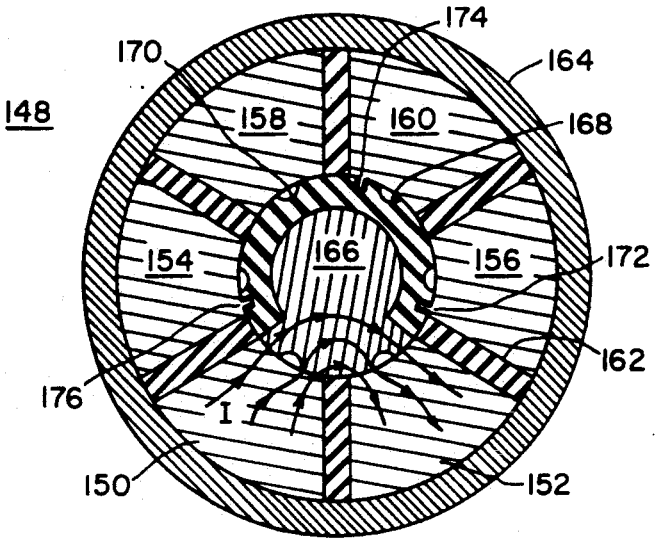
FIG. 9 is a cross-sectional view of a cylindrical three stage stacked rail gun and a three-stage armature/-projectile according to this invention.

An armature/projectile for a circular bore is shown in FIG. 9. Three-turn rail gun 148 is shown in cross-section and includes three rail pairs 150/152, 154/156 and 158/160. Annular containment section 164 holds the rails in place. Each of the rails is insulated from the other rails by an insulating section such as section 162. One stage of the three-stage armature/projectile 166 is shown in cross-section. This stage interconnects rail pair 150/152, and includes insulating section 168. Armature/projectile 166 also includes channels such as channel 170 that decrease gas pressure ahead of armature/projectile 166. Rail gun 148 includes rifling lands 172, 174 and 176 that score armature/projectile 166 as shown and force armature/projectile 166 to follow their curved path along the bore of rail gun 148. This rifling imparts angular momentum to armature/projectile 166 to provide flight stability. Alternatively, armature/projectile 166 can include matching grooves that force it to follow the path of rifling lands 172.

Although the armature/projectile according to this invention has been described only as being rectangular or cylindrical, this is not a limitation of the present invention. An armature/projectile according to this invention can be made virtually any shape, for example an elliptical shape or a multi-faceted geometric shape.

Figure 10:
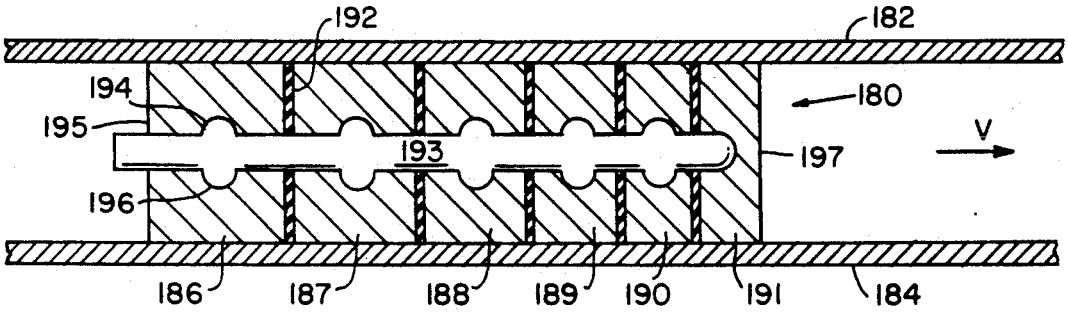
FIG. 10 is a diagrammatic view of another multi-stage armature/projectile according to this invention.
Figure 11:
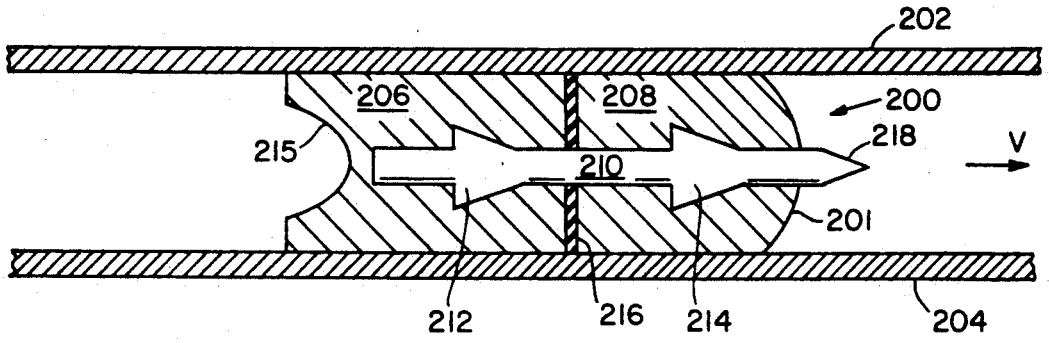
FIG. 11 is a diagrammatic view of yet another multi-stage armature/projectile according to this invention.

Two more embodiments of a multi-stage armature/projectile according to this invention are shown in FIGS. 10 and 11. Six stage armature/projectile 180, FIG. 10, is disposed between six-rail stacks 182 and 184, wherein the insulation between the rails is omitted for clarity. Insulation such as layer 192 isolates the stages from each other. The rails in the two stacks could be arranged to form parallel loops in a six-turn solenoid formed by the armature stages and the rails. Stages 186 through 191 are increasingly shorter, and are mutually insulated by planar insulating sections such as section 192. Non current-carrying projectile 193 passes through all of the stages 186 through 191, and projects from tail 195 of armature/projectile 180 but ends short of nose 197. Projectile 193 includes lobed sections such as sections 194 and 196 in each of the stages. The lobed sections allow projectile 193 to grip stages 186–191 so it stays firmly embedded therein. Projectile 193 may be, for example, an armor-piercing shell or some other payload. Projectile 193 may also be broken up into two or more discrete sections which are located totally within one or more of the stages of armature/projectile 180. If so, additional means of fastening together the resulting three sections would be preferably installed. These means may consist of screws or adhesives between the stages and insulation such as 192, or a combination of more than one method of fastening stages together, some of which are described below.

The lengths of stages 186 to 191 are tailored to distribute the current so it is crowded toward the nose to reduce or eliminate internal stress. This may be accomplished by making stage 190 approximately the square root of 2 or 1.4 times the length of stage 191. If the lengths of the stages is made approximately equal to the square root of n times the length of the nose stage, where n is the stage number counting back from the nose of the armature/projectile, the current of a uniform armature/projectile is distributed to virtually remove internal stress.

Armature/projectile 200, FIG. 11, is disposed between two-rail stacks 202 and 204 and has two stages 206 and 208 where, as in FIG. 10, insulation is not shown for clarity. Insulating section 216 isolates stages 206 and 208 from each other. Projectile 210 interconnects stages 206 and 208 and has flared sections 212 and 214 that grip the stages to firmly embed projectile 210 therein. Projectile 210 includes protruding nose section 218 that protrudes from nose 201 and has an aerodynamic shape. Nose section 218 may be, for example, an armor-piercing shell. Armature/projectile 200 is accelerated between two-rail stacks 204 and 202 in the direction of V. Tail-end surface 215 is curved to provide a contouring tail. Current flow line crowding between end surface 215 and the end of projectile 210 exerts concentrated force on the projectile end.

Joining of stages together as in stages 186 to 187 in FIG. 10 and 206 to 208 in FIG. 11 has been indicated as entirely or mostly through the projectiles. Alternatively, stages may be joined through matching, interlocking profiling. An example is dove tail 510 connecting stages 501 and 502 of armature/projectile 500, FIG. 12A. Another example is matched lobe and channel 538 joining aerodynamic nose stage 534 to middle stage 533 of projectile 520, FIG. 12B. Necessary insulation layers on stages 501 to 504 to insulate each of them from three of the rails in each of the four-rail stacks 518 and 519 so that each stage conductively connects only one rail pair are again not shown for clarity in FIG. 12A. Similarly, insulating layers on stages at the surfaces paralleling the rails are not shown in FIGS. 12B and C, but they are included and clarified in FIG. 12D.

Interlocking connection between stages in FIGS. 12A and B not only provides a much stronger grip than is easily achieved with planar bonding, but also provides the individual stages with the equivalent of contouring tails. Additionally, profiling, for example as shown FIGS. 12A–12D, simplifies assembling of stages. In both rectangled and round bores, as in virtually any other bore shape, the profiles constituting dove tails and interlocking lobes/channels may be straight in the direction normal to both the direction of motion and the shortest direction between the rail stacks as in FIGS. 12A to 12C. Alternatively, they may be parallel to the shortest direction between the rail stacks. In either case, armature/projectiles may be assembled in manufacture by sliding stages along the direction in which the profiling is straight to interlock them. Insulation between adjoining stages could be accomplished most simply by coatings painted on the surfaces before such interlocking. Such insulating layers could double as adhesives.

The arrangements of interlocking profiles in FIGS. 12A, 12B and 12C all have the important additional property of serving as the equivalent of contouring tails for the stages, for example, stages 502, 503 and 504 of FIG. 12A, and stages 533 and 534 of armature/projectile 520, FIG. 12B. These stage tails distribute the current as explained above in connection with contouring tails in FIGS. 4A–4G.

In addition, armature/projectile 500, FIG. 12A, is provided with contouring tail 515 and surface cuts 508. The tail of armature/projectile 520, FIG. 12B, has the property of crowding current flow lines toward nose 537 in accordance with the present invention, but it does not constitute a contouring tail as previously defined since the surface of insulating implantation or baffle 536 does not intersect tail end surface 525. This implantation arrangement in lieu of an actual contouring tail may be advantageous in case the bulk of the current-carrying material is soft, such as would be the case for lithium, wherein backplate 526 could be made of a strong but less conductive or insulating material. Implantation 536 is curved in order to provide a better grip within stage 532, and serves to channel current flow toward the nose of stage 532 as desired.

FIG. 12C introduces the additional concept that interlocking of stages through profiling may also be used in conjunction with projectile 567 or other payloads that do not carry current. Stages 555 and 565 of armature/projectile 540 are interconnected through lobes/channels 568/569. Two-rail stacks 542 and 556 may be arranged to yield parallel turns of the solenoid represented by the stacked gun, or to be mutually inclined.

Figure 12E:
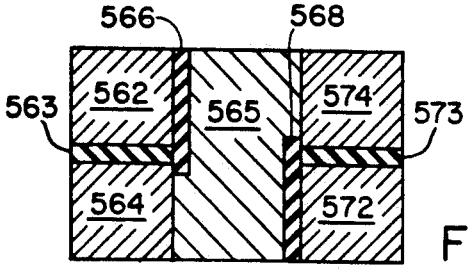

The arrangement in the case of inclined solenoid turns is demonstrated in FIGS. 12D and 12E. Rail pairs 562/572 and 564/574 are conductively connected through stages 565 and 575, FIG. 12D. A cross section of the armature/projectile at plane A—A in FIG. 12D cutting through stage 565 and rail stacks 562/564 and 572/574 is shown in FIG. 12E. Insulation layers 563 and 573 separate the two rail pairs, and insulation layer 569 separates stages 565 and 575. Insulation layers 566, 568 and 570 are current channeling means. Layers 566 and 568 separate stage 565 from rails 562 and 572, respectively. Insulation layer 570 interlocks stages 565 and 575 and insulates stage 575 from rail 574. Dove-tails 576, 577 and 578 interlock stages 565 and 575 with a profiling that extends across the gap between rail stacks 562/564 and 572/574.

FIGS. 13A–13C demonstrate two other principles, namely that the current may be transmitted through a non-current carrying payload through cavities in it extending from side to side, and that by proper dimensioning of such cavities, stage parts which serve no further function after launch may be stripped off through selective melting. Armature/projectile 220, FIG. 13A, includes three distinct stages 226, 228 and 230. These stages are each approximately the same length and are separated by increasingly smaller distances. This arrangement provides a generally increasing current density along the length of armature/projectile 220 as desired. Projectile 232 passes through and interconnects each of the stages.

Projectile 232 is shown in detail in FIG. 13B, and includes apertures 234, 235 and 236 that are shown in phantom in FIG. 13A. Apertures 234, 235 and 236 are used to firmly embed projectile 232 in stages 226, 228 and 230 respectively, and to channel current across the two sides, for example from the left part **228*a* of stage 228 through aperture 235 to the right part 228*b* of stage 228. As a result, current is crowded in apertures 234, 235 and 236, and temperatures will be highest here. Dimensioning apertures 234, 235, and 236 appropriately, the parts of stages 226, 228 and 230 in them can be made to soften or melt to strip the stages from projectile 232** as it is launched.

Assembly may be made by forming each stage out of two sections, for example 228a and 228b. Each section has a protruding part 237 that interlocks with the complementary protruding part on the other stage section. The interlocked protruding parts fit through aperture 235 and hold the stage sections onto projectile 232. Through selective melting of parts 237 and/or the launch force, stages 226, 228 and 230 are stripped off of projectile 232 when it is launched to allow the unencumbered projectile to reach its target.

FIGS. 14A and 14B illustrate a use of two stages making electrical connection with the same rail pair. Stages 690 and 692, shown in cross-section in FIG. 14A, interconnect rails 662 and 672. They are insulated from rail pair 664/674 by current channeling insulators 665 and 675. While in the barrel, stages 690 and 692 are held in fixed relative position to each other and projectile 667 through multiple matching tapered posts and holes 681 and 683, and through gripping a narrowed waist of projectile 667. On emergence from the barrel, stages 690 and 692 are released from the projectile through irregular forces of deceleration and turbulence that act to disengage the tapered posts and holes.

FIG. 14B is the lengthwise cut of FIG. 14A along line A—A, and only stage 632 of the second stage pair of armature/projectile 659 is shown in FIG. 14B. The two stages or stage sections in each of the two pairs of stages are geometrically alike and thus would be interchangeable in assembly. The length of the two waists of projectile 667 is indicated by dotted lines 695 in FIG. 14B, and the diameter of the projectile outside of the waists is indicated by dotted line 699 in FIG. 14A. Again the length of the stages is made to decrease toward the nose in this example. Lines 698 indicate the interface between the stages and the projectile. Tapered posts 681 of stage 692 and 657 of the stage, not shown, that matches stage 632, hold the stage pairs together until they separate on launching. Thus, stage pairs 690 and 692 together act as a single stage until launching is complete.

The principle of parallel stages indicated in FIGS. 14A and B is applicable to an arbitrary number of stages and is not restricted to multi-turn stacked rail guns. Thus, for example, in FIGS. 14A and B the stage pair at the nose as well as insulators 663 and 673 could be omitted. In stages 690 and 692, current channeling insulators 665 and 675 could be replaced by current channeling means appropriate to single turn guns, for example implanted baffles, to form contouring tails in stages 690 and 692.

Twisted-rail rail gun 240, FIG. 15A, includes rails of rail-stacks 242 and 244 which together with the insulating spacers, not shown, define a rectangled bore with its shorter side equal to the spacing of rail stacks 242 and 244. By twisting the rails as shown, the similarly twisted armature/projectile that passes between the rails can be launched with angular momentum. This is an alternative to the rifling shown in FIG. 10 that is applicable to any bore shape except circular.

Two-stage armature/projectile 250, FIG. 15B, is shaped to be used in a twisted-rail rail gun of the type of FIG. 15A but with a square bore. Armature/projectile 250 is outwardly shaped like a twisted bar with square cross-section. It includes stages 252 and 254 separated by insulator 253.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An armature for a multi-turn rail gun comprising: a nose; a tail; and a current carrying section between said nose and said tail including a plurality of discrete current carrying stages aligned in the direction of motion of said armature and electrically in series so that each said stage carries substantially the full launching current for reducing the current concentration in the tail end of said section and distributing the current toward the nose to generally balance the electrically induced driving force in said section with the inertial force and substantially reduce internal stress in said section, all of said stages being approximately the same length and spaced increasingly closer together from the tail to the nose of the armature to generally increase the current density of said section from the tail to the nose.

2. An armature for a multi-turn rail gun comprising: a nose; a tail; and a current carrying section between said nose and said tail including a plurality of discrete current carrying stages aligned in the direction of motion of said armature and electrically in series so that each said stage carries substantially the full launching current for reducing the current concentration in the tail end of said section and distributing the current toward the nose to generally balance the electrically induced driving force in said section with the inertial force and substantially reduce internal stress in said section, the length of said stages generally decreasing from the tail to the nose of said armature to generally increase the current density of said section from the tail to the nose.

3. The armature of claim 2 in which the length of the nth stage of said section counting back from the nose of said armature is approximately the square root of n times the length of the stage closest to the nose.

* * * * *